US009133000B2

(12) United States Patent
Barbetti et al.

(10) Patent No.: US 9,133,000 B2
(45) Date of Patent: Sep. 15, 2015

(54) APPARATUS FOR VERTICAL BALANCED MOVEMENT

(71) Applicants: Mauro Barbetti, Correggio (IT); Michele Barbetti, Correggio (IT); Gianfranco Pellacani, Correggio (IT); Simone Cocchi, San Martino in Rio (IT)

(72) Inventors: Mauro Barbetti, Correggio (IT); Michele Barbetti, Correggio (IT); Gianfranco Pellacani, Correggio (IT); Simone Cocchi, San Martino in Rio (IT)

(73) Assignee: TECO S.R.L., Correggio (IT)

( * ) Notice: Subject to any disclaimer, the term of this patent is extended or adjusted under 35 U.S.C. 154(b) by 115 days.

(21) Appl. No.: 14/054,284

(22) Filed: Oct. 15, 2013

(65) Prior Publication Data

US 2014/0119854 A1 May 1, 2014

(30) Foreign Application Priority Data

Oct. 25, 2012 (IT) ..... MO2012A0261

(51) Int. Cl.

| | |
|---|---|
| ***B66F 7/00*** | (2006.01) |
| ***B66F 7/06*** | (2006.01) |
| ***B66F 7/28*** | (2006.01) |

(52) U.S. Cl.

CPC . *B66F 7/00* (2013.01); *B66F 7/065* (2013.01); *B66F 7/28* (2013.01)

(58) Field of Classification Search

USPC ..... 187/211, 215, 269; 254/122, 270, 2 C, 254/8 C, 93 R; 414/21, 719; 700/279, 301, 700/305; 901/48; 91/391 R, 454

See application file for complete search history.

(56) References Cited

U.S. PATENT DOCUMENTS

| | | | | |
|---|---|---|---|---|
| 2,862,689 | A * | 12/1958 | Dalrymple et al. | 254/8 C |
| 3,593,980 | A * | 7/1971 | McHenry | 267/106 |
| 4,753,419 | A * | 6/1988 | Johansson | 254/122 |
| 4,955,195 | A * | 9/1990 | Jones et al. | 60/405 |
| 4,964,781 | A * | 10/1990 | Jenkner | 414/790.7 |
| 5,328,153 | A * | 7/1994 | Levinson | 254/2 R |
| 5,456,130 | A * | 10/1995 | Pierson et al. | 74/469 |
| 5,816,132 | A | 10/1998 | Langner et al. | |
| 6,370,970 | B1 * | 4/2002 | Hosokawa et al. | 73/862.56 |
| 7,617,759 | B2 * | 11/2009 | Bachman | 91/1 |
| 2003/0106421 | A1 * | 6/2003 | Kimura | 91/454 |
| 2009/0013860 | A1 * | 1/2009 | Givens | 91/433 |
| 2010/0012907 | A1 * | 1/2010 | Lee | 254/131 |
| 2010/0051390 | A1 * | 3/2010 | Buzzi | 187/211 |
| 2010/0107757 | A1 | 5/2010 | Nicolini | |

FOREIGN PATENT DOCUMENTS

| | | |
|---|---|---|
| EP | 0839614 | 5/1998 |
| EP | 1201575 | 5/2002 |
| JP | H05163000 | 6/1993 |

* cited by examiner

*Primary Examiner* — Gregory Adams
(74) *Attorney, Agent, or Firm* — Themis Law

(57) ABSTRACT

A balanced vertical moving apparatus for moving a body having a first weight toward, or from, a selected elevation includes a loading device, on which the body is designed to be loaded; a moving system powered by a power source; a first detection unit detecting the first weight, which is interposed between the loading device and the moving system; a storage system storing a reference weight in a storage device; and a drive system driving the moving system, which is connected to the first detection unit and the storage system and is designed to actuate the moving system, the drive system having at least two alternately selectable operating states, a first lifted state and a second lowered state, which are both designed to be selected by an external control system, a third automatic actuation state being selectable when an additional external force is applied to the loading device.

11 Claims, 21 Drawing Sheets

APPARATUS FOR VERTICAL BALANCED MOVEMENT

FIELD OF THE INVENTION

The invention relates to a balanced vertical moving apparatus, which is generally employed for precision lifting of vehicle wheels to an elevation from the ground where a balancing shaft of a vehicle wheel balancing machine is situated.

BACKGROUND ART

Lifting devices are known, which are typically fabricated by manufacturers of tire changing machines and vehicle wheel balancing machines, with the purpose of assisting tire repairers in displacing vehicle wheels from one machine to the other, and in properly positioning these wheels on the balancing shafts of balancing machines, by lifting them above the ground.

Particularly, a known lifting device generally comprises a horizontal platform which is designed to receive a wheel vertically or substantially vertically loaded thereon, when the platform is placed in contact with the ground.

The platform is supported by a lifting system that is supported by a frame and may have a hydraulic or, more frequently, a pneumatic operation, with the thrust of at least one fluid-dynamic actuator.

The fluid-dynamic actuator is supplied with a pressurized fluid, such as air, which comes from a fluid source in the lifting device itself, or is derived from one of the machines with which the lifting device may be combined during its operation.

Typically, once a tire changer has completed the replacement of a tire on a wheel rim and has inflated it again, he/she removes the wheel from the working table top of the tire changing machine and puts it in a vertical position on the platform of the lifting device that has been previously lowered level with the ground.

Then, he/she actuates the fluid-dynamic actuator, by a special control, and the actuator lifts the platform parallel to itself until the latter reaches an elevation at which the central hole of the wheel rim is substantially aligned with the axis of rotation of the horizontal rotating shaft of the balancing machine.

Then, the tire repairer transversely pushes the wheel on the platform toward the balancing shaft until the latter is received in the central hole of the rim.

While the platform is lifted, the tire repairer fits a conical head behind the wheel on the balancing shaft, which head is designed to fasten the wheel against an abutment flange that is typically provided in the area where the balancing shaft is connected to its machine.

While the platform supports the weight of the wheel, the tire repairer will fasten it by tightening the conical head on the balancing shaft, which has an externally threaded section for this purpose.

The conical profile of this head progressively enters the central hole of the rim and simultaneously centers it relative to the longitudinal axis of rotation of the balancing shaft and progressively fastens it in this position against the abutment flange.

Then, the tire repairer lowers the platform again for dynamic wheel balancing.

Once the balancing process has been completed, the tire repairer lifts the platform again until the latter contacts the wheel and supports its weight.

Then, the tire repairer removes the fastening head and slips the wheel off the balancing shaft onto the platform, which is lowered again to unload the balanced wheel.

All operations on the wheel are performed with the assistance of the lifting device, allowing the tire repairer to avoid the efforts caused by vertical movement of the wheel, especially with large and heavy wheels such as those of an industrial, agricultural or heavy-duty vehicle.

A "lifting device, particularly for lifting wheels of vehicles and the like, for wheel balancing and tire removing machines" is known from EP 2 161 235.

This document discloses a scissor-like lifting device, which lifts vehicle wheels without requiring great efforts by operators, and is actuated by a pneumatic linear actuator which comprises a hermetic body in which a piston slides to divide it into two half-chambers.

The liner of the actuator has one end hinged to the base of the lifting device, with a stem projecting out of the opposite end and connected with the piston that has one free end equipped with a roller.

When the actuator extends, this roller simultaneously engages a cam profile embossed in the base and the profile of the bottom surface of one of the two mutually converging rods hinged in scissor-like fashion.

One of the half-chambers, namely the one designed to be supplied for the lifting operation, is connected to an additional pressure accumulator, and when this half-chamber is supplied with pressurized air, the stem progressively comes out of the body and the roller wedges between the two profiles, thereby lifting and pushing up the rod contacted thereby.

A horizontal platform is fixed above the scissor-lie rods, for receiving the objects (vehicle wheels) to be lifted, such platform moving in the same direction as the rod pushed by the roller, i.e. upwards or downwards.

While the first half-chamber of the actuator is being supplied with air, the other half-chamber is discharged for the piston to slide in the direction of fluid pressure.

As soon as the desired elevation is reached, the supply of pressurized air both to the half-chamber and to the additional accumulator is stopped, and the pneumatic circuit is completely closed.

In this condition, the operator may effortlessly move the platform upwards and downwards, and keep it in the selected position.

WO99/40406 discloses an "auxiliary apparatus for handling car wheels in connection with wheel or tire servicing".

Also in this case, the lifting apparatus consists of a vertically movable platform, which is actuated by a fluid-dynamic actuator.

More particularly, the platform is supported by a pair of extensible arms, which allow the operator to move it toward or away from a machine that controls it.

Like in the previous document, the fluid-dynamic actuator comprises an outer liner with a piston slidably mounted therein to divide it into two half-chambers and again the half-chamber designed to be supplied for lifting the platform is connected to an additional pressurized air accumulator.

Two valves are connected to the half-chambers of this actuator, and they alternately open or close to cause the platform to move up or down.

As soon as the selected elevation is reached, the operator stops the supply of pressurized air from the source to the accumulator and to the half-chamber connected thereto and also closes both control valves: this will close the pneumatic circuit, like in the previous case, whereupon the operator may impart small vertical movements to the platform for optimized alignment thereof with a reference point or axis.

Prior art document U.S. Pat. No. 3,593,980 discloses a "pneumatic balancer" which, like in the previous cases, is actuated by a fluid-dynamic actuator, the latter being divided by the piston into two half-chambers, one of which, i.e. the one in which the piston is designed to run its forward stroke, is connected to an additional accumulator for pressurized fluid (air).

This document discloses a counterbalancing circuit, which automatically balances the amount of pressurized air in the additional accumulator and in the half-chamber of the actuator connected thereto, by adapting it to the weight of the body to be lifted.

This prior art suffers from certain drawbacks.

A first drawback of the device disclosed in EP 2 161 235 is that the additional accumulator is required to have a volume comparable to the maximum volume allowed for the first chamber of the actuator, for effectively limiting pressure reduction therein, as the piston is displaced and the platform is lifted.

For this reason, the amount of compressed air to be introduced into the first half-chamber of the actuator and the additional accumulator connected thereto for lifting a body of a given weight is about twice the amount of air that should be introduced therein if the actuator were not connected to the accumulator, and pressurized air were directly introduced into the first half-chamber of the actuator, progressively as the platform is raised.

Therefore, the power consumed to generate the compressed air required for the lifting operation is also twice as much.

If a fraction of the lifting stroke of the lifting device is only required, the above mentioned ratio of the amount of air introduced into the first half-chamber of the actuator and the additional accumulator to the small amount of air required if it were directly introduced in the first half-chamber only will increase.

A second drawback of this device is that, when it is used for loading or unloading a body on or from a device of a machine that is designed to support it, in order to move the platform back to its rest position and separate it from the body once the latter has been secured to the support device of the machine, pressurized air must be introduced into the second half-chamber of the actuator, opposite to the first half-chamber with respect to the piston, and at the same time the air in the first half-chamber and the additional accumulator must be compressed, whereas the air in the second half-chamber of the actuator must be discharged when the opposite operation must be carried out, to move the platform back to the position in which it supports the body as the latter is removed from the support device of the machine.

This is required to avoid the need of changing the amount of air in the first half-chamber of the actuator, which need would exist if the platform were moved down by discharging air from the first half-chamber and the additional accumulator, because if the amount of air were not changed, the body could no longer be supported by the platform while it is removed from the support device of the machine.

This will further increase consumption of compressed air, and the power required for generating it.

Furthermore, the operator is required to carry out two different procedures to move the platform down to the rest position, depending on whether he/she wants to separate it from the body secured to the support device of the machine by introducing compressed air into the second half-chamber or to lower the body back level with the ground after removing it from the device to unload it from the platform, by discharging air from the first half-chamber of the actuator and the accumulator, and this is a complex arrangement, which increases the probability of incurring errors during operation of the device.

A third drawback is that, during the above described step of forced compression in the first half-chamber of the actuator, pressure in such first half-chamber of the actuator increases, but must be maintained below the maximum pressure admitted in the second half-chamber of the actuator, which is by itself a substantially low value.

Therefore, in order to prevent pressure in the first half-chamber of the actuator and the accumulator from exceeding this limit even when the lifting device is used to lift bodies whose weight is close to the maximum weight that can be lifted by the device, the volume of the additional accumulator must be increased, to limit the percent change of the overall volume contained in the first half-chamber of the actuator and the additional accumulator.

This produces the effect of further increasing the consumption of compressed air and the power required to fill with compressed air both the additional accumulator and the first half-chamber of the actuator.

A further drawback is that the device as taught in EP 2 161 235 requires constant temperature of air in the first half-chamber of the actuator and the additional accumulator, considering that the document assumes that the pressure in the first half-chamber of the actuator and the additional accumulator and the volume enclosed thereby are inversely proportional.

Such constant temperature requirement is only met when volume changes are substantially small or slow, since the walls of the actuator and the accumulator, which are typically thin and made of metal, are good heat conductors and tend to quickly eliminate any minor temperature change with respect to the surrounding environment.

However, the constant temperature requirement is not met, at least temporarily, when large and quick volume changes occur, such as during the forced compression required to separate the platform from the body that has been secured to the support device of the machine or during free expansion, that occurs when the platform is moved back to the position in which it supports the body during removal thereof from the support device of the machine.

Particularly the temperature of air in the first half-chamber of the actuator and the additional accumulator is temporarily but considerably reduced during this second step, thereby entailing a temperature reduction in both, relative to the temperature of the surrounding environment.

This results in a pressure drop in the first half-chamber of the actuator, to a value below the required value, and this pressure drop causes the lifting device to be temporarily unable to support the weight of the body during removal thereof from the support device of the machine, and adds difficulty to these operations.

A further drawback that particularly concerns the auxiliary apparatus as taught in WO99/40406 is that, if the auxiliary apparatus is used for loading and unloading bodies that must be secured to support devices of machines with adequate precision, e.g. for loading and unloading vehicle wheels on and from balancing shafts of balancing machines, the operator is required to accurately locate the initial balance position of the support platform close to the ideal transfer position of the lifted wheel, i.e. with the central hole of the rim horizontally aligned with the balancing shaft of the machine, to reduce the efforts required for minor adjustments of the vertical position of the support platform and the wheel supported thereby.

This requires the first valve means to cause a slow displacement of the support platform.

This requirement is particularly demanding because, according to the weight of the lifted wheel or the height at which the support has to be moved change, and namely according to the diameter of the wheel to be lifted to the elevation coaxial with the balancing shaft of a balancing machine, the operator is required to adjust the amount of air in the first half-chamber and the additional accumulator, by controlling the first valve means.

A further drawback that affects the pneumatic balancer disclosed in U.S. Pat. No. 3,593,980 is that the automatic balancing operation always restores the initial balance position of the system to the same height, which is unacceptable when the height that must be reached by the support platform is required to significantly change according to the size of the lifted body, as is the case of a lifting device that is used for loading and unloading vehicle wheels on and from balancing machines, i.e. when the height that must be reached by the wheel support changes with the outside diameter of wheels.

SUMMARY OF THE INVENTION

One object of the invention is to improve the prior art.

Another object of the invention is to provide a device for balanced lifting and lowering operations, allowing operators to effortlessly lift or lower a body, such as a wheel of a vehicle, to move it to a precise elevation, selected with respect to a starting level and keep the device for balanced lifting and lowering operations, and hence the lifted body at the selected elevation as operations are carried out on the body.

A further object of the invention is to provide a device for balanced lifting and lowering operations that can move away from the lifted body-support position when the body is transferred to and supported by another support device, such as an operating machine, and can move back to the body support position to support it during transfer thereof in the opposite direction, i.e. when the operating machines has completed its operations thereon.

In one aspect the invention relates to a device for balanced lifting and lowering operations as defined hereinafter.

The invention affords the following advantages:

providing a device for balanced lifting and lowering operations, allowing operators to effortlessly lift or lower a body, such as a wheel of a vehicle, to move it to a precise elevation, selected with respect to a starting level and keep the device for balanced lifting and lowering operations, and hence the lifted body, at the selected elevation as operations are carried out on the body.

providing a device for balanced lifting and lowering operations that can move away from the lifted body-support position when the body is transferred to and supported by another support device, such as an operating machine, and can move back to the body support position to support it during transfer thereof in the opposite direction, i.e. when the operating machines has completed its operations on the body.

BRIEF DESCRIPTION OF THE DRAWINGS

Further characteristics and advantages of the invention will be more apparent from the detailed description of a few preferred, non-exclusive embodiments of a balanced vertical moving apparatus, which are described as non-limiting examples with the help of the annexed drawings, in which.

DETAILED DESCRIPTION OF A PREFERRED EMBODIMENT

Figure 1A:
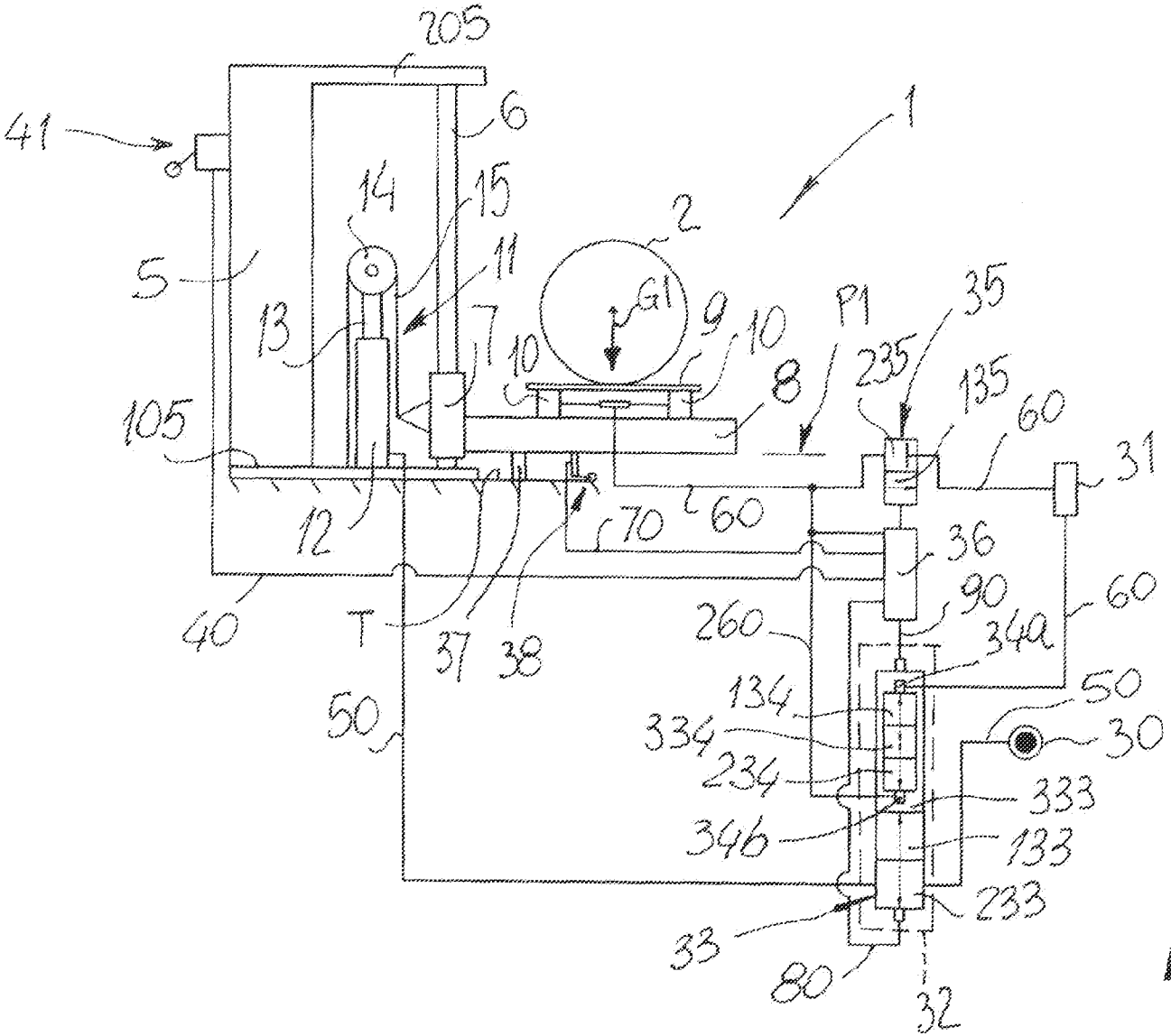
FIG. 1*a* is a diagram of the functional connections of the vertical moving apparatus of the invention, in a state in which a vehicle wheel to be lifted is loaded.

Referring to the accompanying figures, numeral 1 generally designates a balanced vertical moving apparatus, which is particularly adapted to lift vehicle wheels 2 from a starting plane P1 (FIG. 1*a*), e.g. a plane on which the wheel 2 is loaded or unloaded, to a predetermined final plane P2 (FIG. 9*a*), such as the lying plane for a wheel aligned with a balancing shaft 3 of a balancing machine 4.

The balanced vertical moving apparatus 1, briefly referred to hereinafter as apparatus 1, comprises a frame 5 that supports a pair of parallel and vertical posts 6 along which a pair of sleeves are slidably mounted, and support a horizontal shelf 8 in cantilever fashion.

A platform 9 is placed on the shelf 8 for receiving a wheel 2 with a first weight (dead load) "G1", loaded thereon.

First detection means 10 are interposed between the platform 9 and the shelf 8, for detecting the actual dead load of the wheel 2 when the shelf 9 is in a state in which lifting to a plane P3 (see FIG. 3*a*) has started, and in which it has already raised from the ground "T", as better explained below.

The apparatus 1 comprises moving means 11 for moving the platform 9 and the shelf 8 on which it is arranged.

In a possible first embodiment, as shown in FIGS. 1*a* to 9*a*, the moving means 11 may consist of a fluid-dynamic actuator unit 12, having a movable stem 13, with a pulley 14 at its free top end.

The peripheral groove of the pulley 14 has a cable segment 15 engaged therein, with an end attached to a base 105 of the frame 5 and the opposite end attached to the two sleeves 7.

Figure 10:
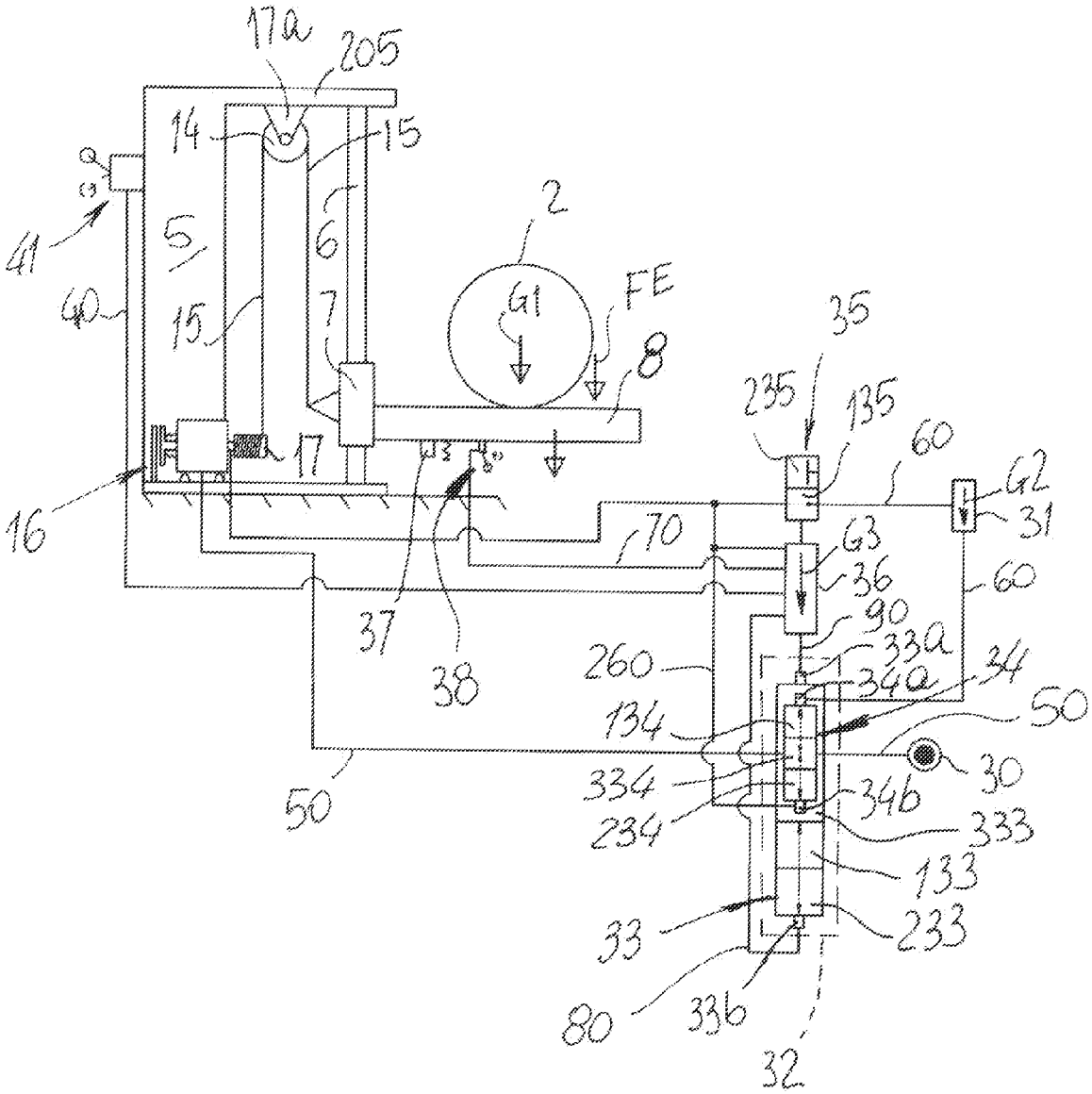
FIG. 10 is a diagram of the functional connections of the vertical moving apparatus of the invention, in a second possible embodiment.

In another embodiment, as shown as FIG. 10, the moving means 11 may comprise a winch 16 with a drum 17 for winding a cable segment 15 on the winch 14 which, in this case, is fixed to a ceiling 205 of the frame 5 with appropriate support brackets 17*a*.

Figure 11:
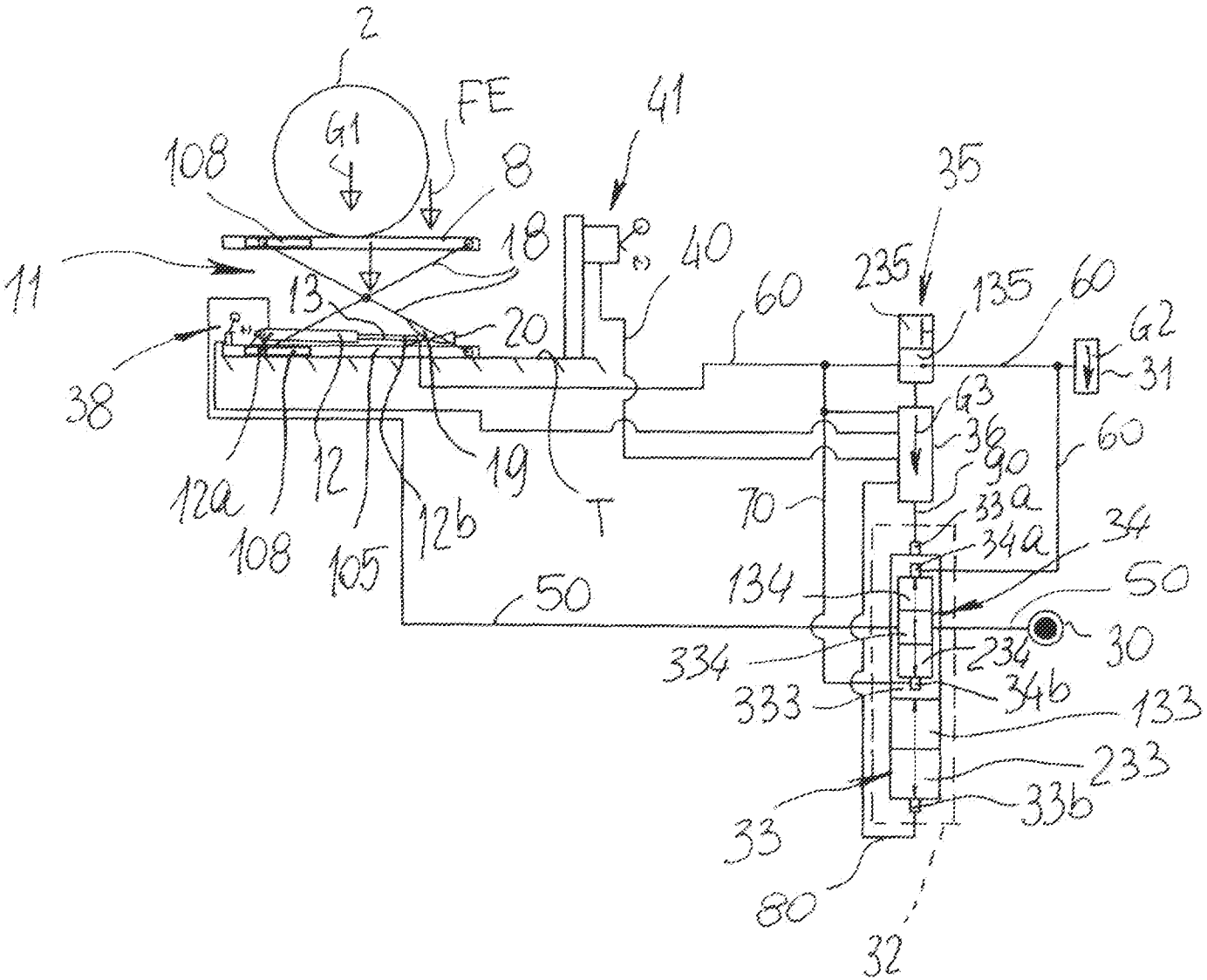
FIG. 11 is a diagram of the functional connections of the vertical moving apparatus of the invention, in a third possible embodiment.
Figure 12:
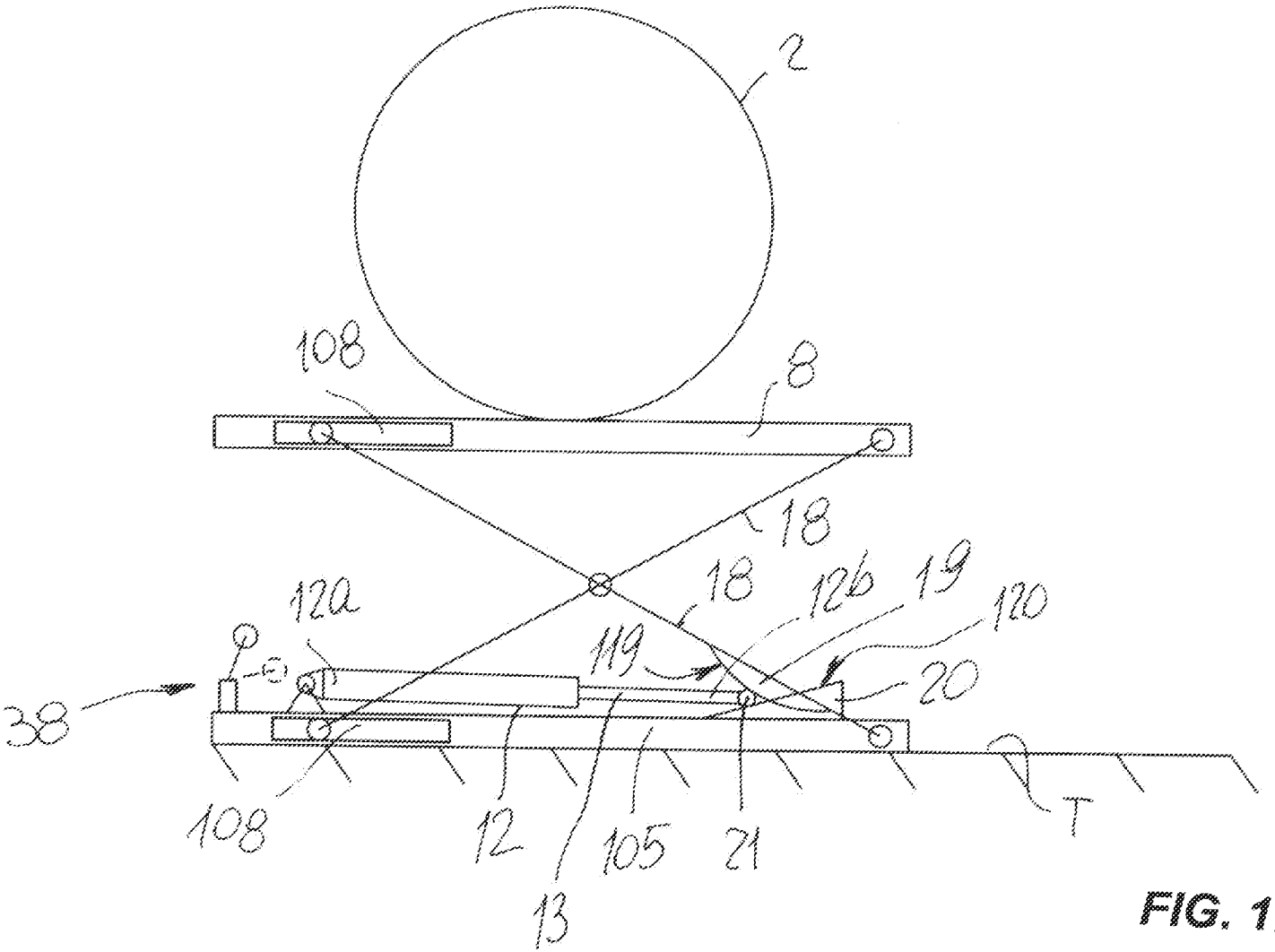
FIG. 12 is a diagrammatic, broken-away enlarged view of the functional connection diagram of FIG. 11.

In a third embodiment, as shown in FIG. 11, the moving means 11 comprise a scissor- or crossed arm-like frame arms 18, which is interposed between the base 105 and the shelf 8 and is actuated by the fluid-dynamic actuator unit 12, which in this case has a substantially horizontal orientation.

The fluid-dynamic actuator unit 12 has one end 12*a* hinged to the base 105 and the opposite end 12*b* wedging between two opposite cam profiles 19 and 20, which are respectively fixed to one of the arms of the scissor-like frame 18, with a slide surface 119 facing the base 105, and to the base 105 itself with the slide surface 120 facing the shelf 8.

As shown in the figures, the slide surface 119 is substantially rounded, whereas the slide surface 120 is straight and slanted.

For improved wedged sliding between such slide surfaces, the free end of the stem 13 is equipped with a freely rotating roller 21.

Referring to the figures, the moving means 11 are shown to be connected to a power source referenced 30.

Storage means 31 are provided between the power source 30 and the moving means 11 in the apparatus 1, for storing actual weight values of the wheel 2 in a state in which the latter does not rest on the ground "T", such values becoming reference values "G2".

The apparatus 1 also comprises drive means 32 which are designed to drive the movements of the moving means 11 according to certain operating conditions as described in further detail below.

A first distributor 33 is interposed between the power source 30 and the moving means 11, and has three alternately selectable operating states, namely a first operating state in which the shelf 8 moves up, referenced 133, the second operating state in which it moves down, referenced 233, and the third operating state, referenced 333.

The latter state is provided at the second distributor 34 which, in the conditions stated below, automatically actuates an up-control 134 or a down-control 234 or a stop-control 334 for moving the shelf 8 to a predetermined position.

Second detection means 36 are provided for driving the first distributor 33, which can simultaneously detect the position of a control 41 that can be actuated by an operator, the position of a contact sensor 38, as described below, and the presence of a wheel 2 on the platform 9.

Referring to the figures, the source 30 is shown to be connected to a line 50 for connection to the moving means 11, which is intercepted by the first distributor 33.

The second distributor 34 has one end 34*a* connected to the storage means 31 by a line 160 and one end 34*b* connected to a line 60 by a bypass line 260, and can thus compare the values of the reference weight "G2" as stored in the storage means 31, the first weight "G1" of the wheel 2 and a force "FE" that may be applied to the shelf 8 from outside.

Controlling means 35 are also arranged on the line 60 that connects the first detection means 10 with the storage means 31, such controlling means being in one of two operating positions, an open position 135 or a closed position 235, and being designed to allow or prevent storage of reference weight values "G2" in the storage means 31.

The point of connection of the bypass line 260 with the line 60 is provided upstream from the controlling means 35.

The bottom of the shelf 8 is equipped with a pad 37 for resting on the ground "T" and a contact sensor 38, which is designed to detect when the shelf 8 moves out of contact with the ground "T" and raises the word the plane P2.

Still referring to the figures, the control 41 is actuated by an operator to select the functions of lifting or lowering the shelf 8, when no forces are applied thereon from the outside.

The control 41 is connected to the second detection means 36 by a line 40 and the contact sensor 38 is also connected to the latter by its own connection line 70.

The second detection means 36 are also connected to the ends 33*a* and 33*b* of the first distributor 33 by two connection lines 80 and 90.

In the pneumatic circuit diagrams as shown in FIGS. 1*b* to 9*b* the same reference numerals are used to designate the same elements as schematically shown in FIGS. 1*a* to 9*a*, for quickly locating them.

Referring to FIG. la that shows a starting operating step of the apparatus 1 in which the wheel 2 is loaded on the shelf 8, namely on the platform 9, the sensor 38 detects contact with the ground "T", and sends a signal to the second detection means 36.

The control 41 is selected by the operator in the lowered state, and the power source 30 is disconnected from the actuator unit 12 and the first distributor 33 is in the lowering operating state 233.

In this state, the controlling means 35 are held in the closed position 235, whereby the storage means 31 can receive no signal from the first detection means 10.

Figure 1B:
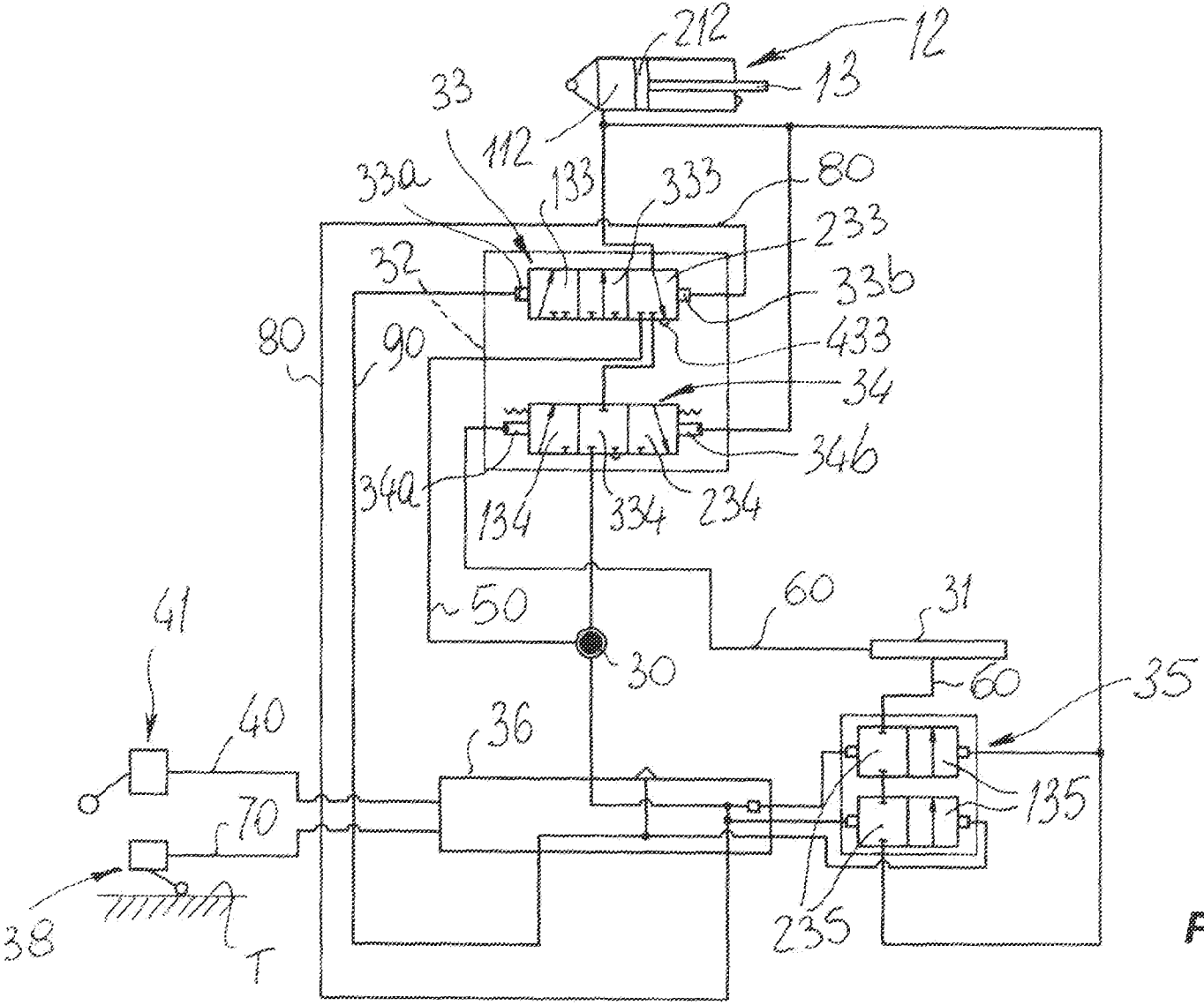
FIG. 1*b* is an exemplary diagram of a pneumatic circuit for actuation of the moving apparatus as illustrated in the diagram of FIG. 1*a;*

Referring now to FIG. 1*b*, the pneumatic circuit for supplying the actuator unit 12 is shown in the lowering operating state 233.

More in detail, the first distributor 33 is shown in the discharging state 233, in which the supply chamber 112 of the actuator unit 12 is connected to a discharge 433 of the first distributor 33: the piston 212 of the actuator unit 12 moves to the left relative to a viewer, and holds the shelf 8 and the platform 9 lying thereon in the lowered position.

Figure 2A:
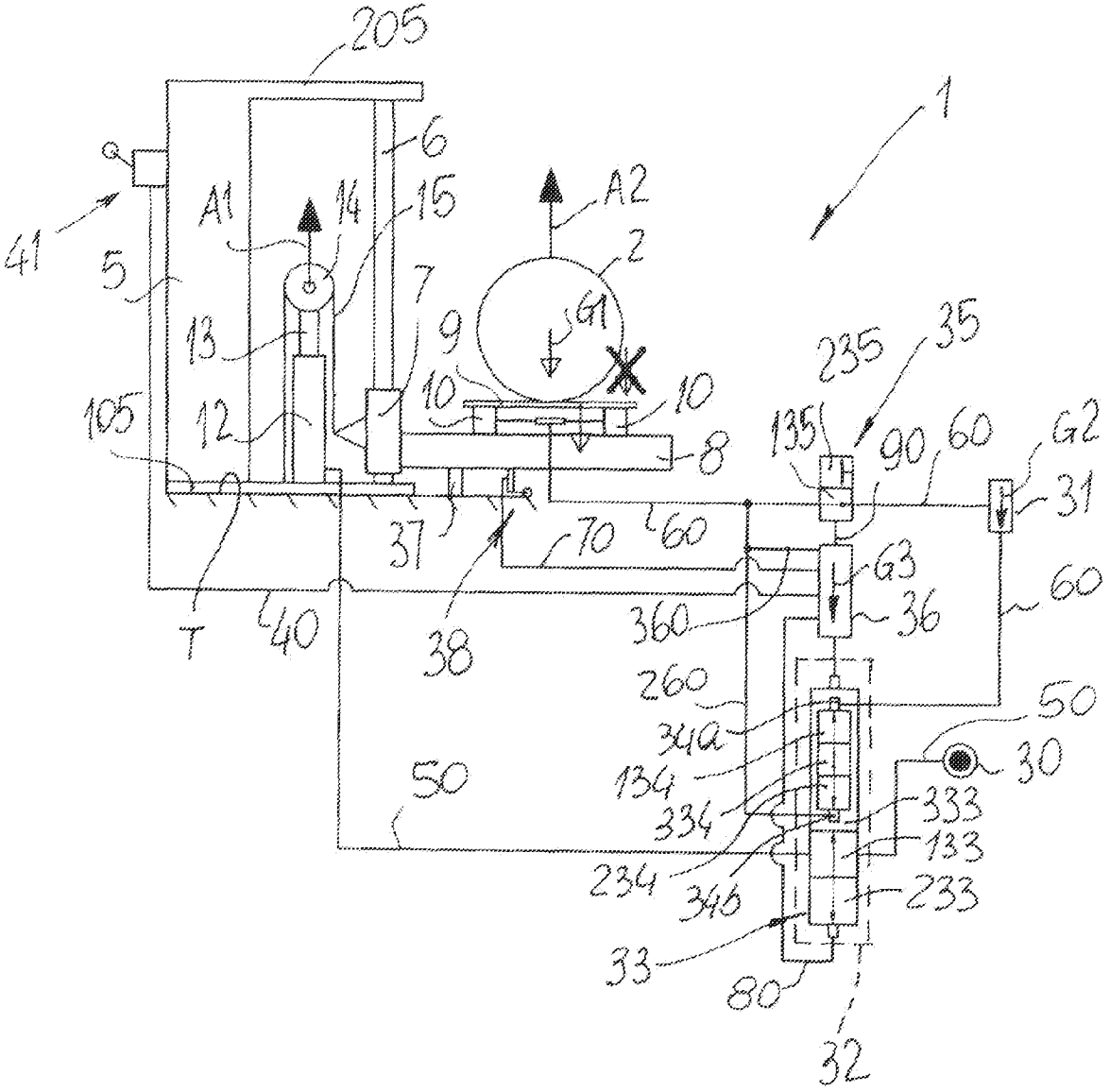
FIG. 2*a* is a diagram of the functional connections of the vertical moving apparatus of the invention, in a state in which lifting of the wheel is started and its weight is detected.
Figure 2B:
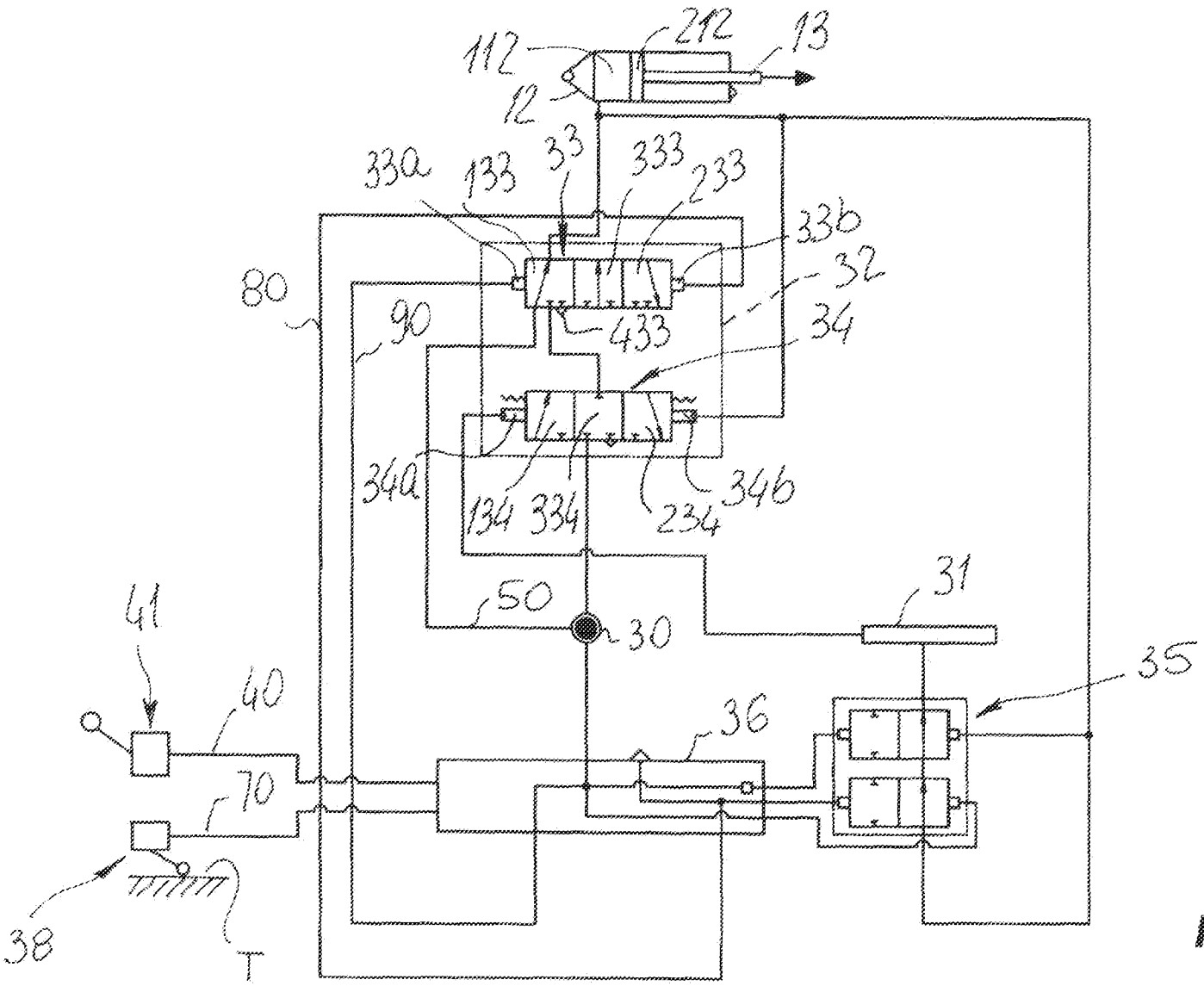
FIG. 2*b* is the diagram of the pneumatic circuit of FIG. 2, in the state of FIG. 2*a;*

Referring now to FIG. 2*a*, the operator has moved the control 41 to the controlled lifted position, as shown by arrows A1 and A2, to start lifting the wheel 2 toward the target plane P2.

In this state, the second detection means 36 detect the new control state 41, the permanent contact state between the sensor 38 and the ground "T" and the presence of the wheel 2 on the platform 9, through a line 360 that connects the first detection means 10 to the second detection means 36.

The latter switch the controlling means 35 to the open position 135: therefore the storage means 31 start to receive a signal with the dead load value "G1" of the wheel 2.

At the same time, the second detection means 36 also act upon the first distributor 33 to switch it to its first lifting operating state 133.

In this state, the power source 30, simply referred to hereinafter as source 30, is connected to the actuator unit 12 through the connection line 50, and starts to supply power to the chamber 112 of the actuator unit 12 which starts to lift the shelf 8.

In this configuration, the first detection means 10 only detect the dead load "G1" of the wheel 2, as no additional external force is applied to the shelf 8, as well as the total weight thereof, in addition to the weights of the first detection means 10 and the platform 9, which are constant and do not affect the operation of the apparatus 1.

Figure 3A:
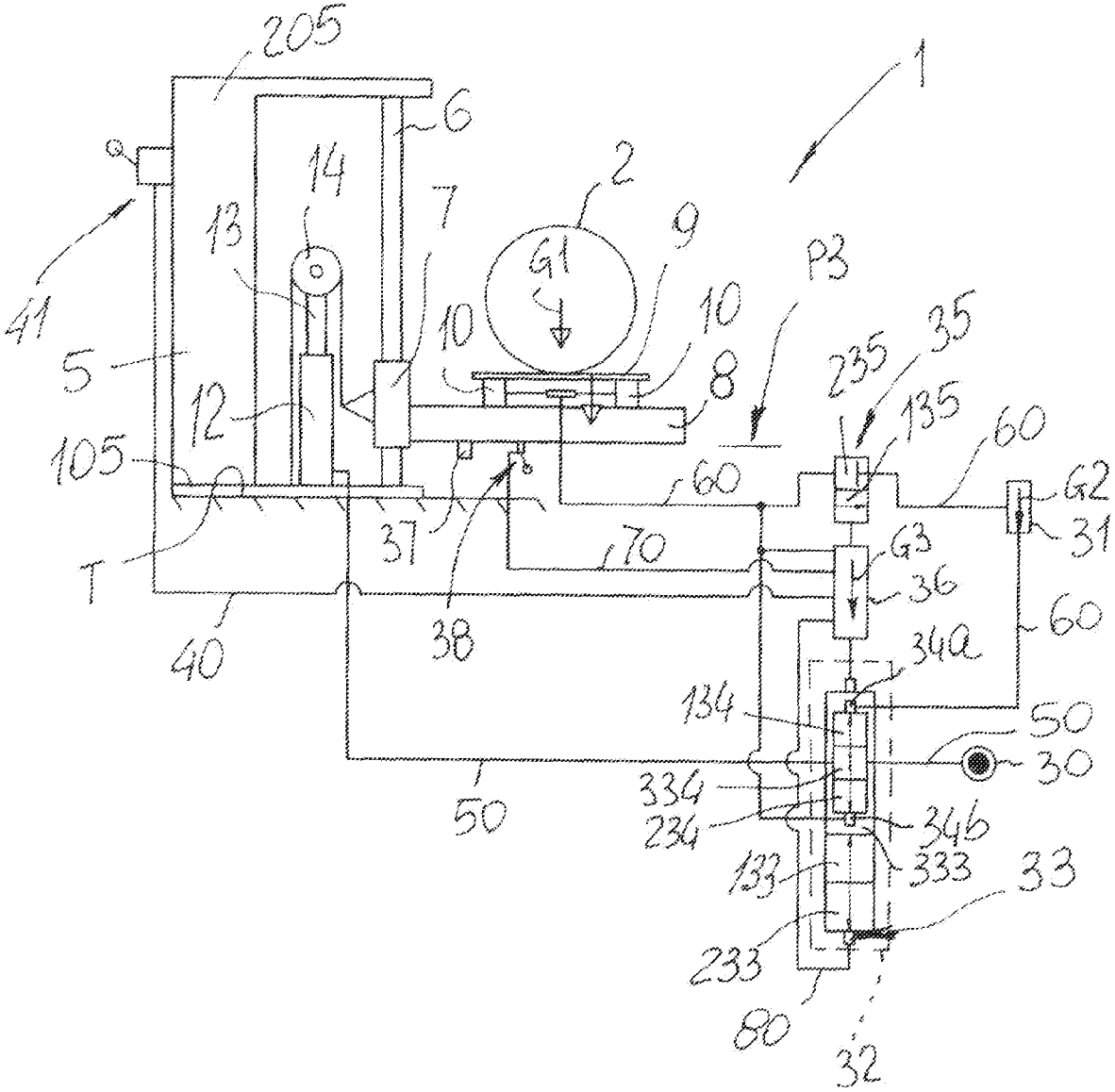
FIG. 3*a* is a diagram of the functional connections of the vertical moving apparatus of the invention, in a state in which lifting of the wheel is started and weight detection has been stopped.
Figure 3B:
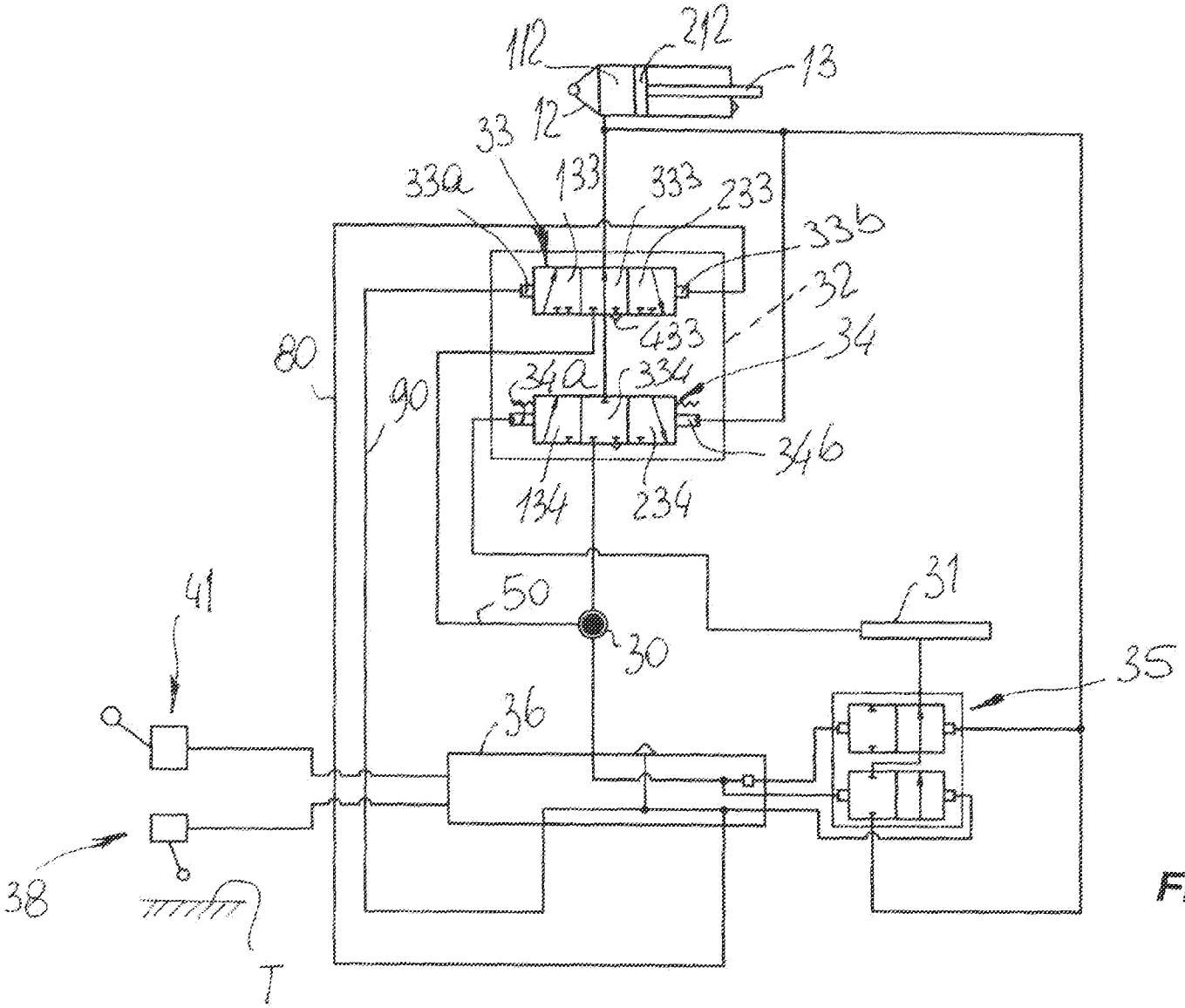
FIG. 3*b* is the diagram of the pneumatic circuit of FIG. 2, in the state of FIG. 3*a;*

As the lifting operation continues, referring to FIG. 3*a*, the shelf 8 reaches a plane P3 at a higher level than the plane P1, to allow the sensor 38 to lift from contact with the ground This lifted state, relative to the ground "T" is detected by the second detection means 36, which switch the first distributor 33 to the operating state 333 in which the second distributor 34 is in the stop control state 334.

More in detail, the shelf 8 stops rising as it reaches the plane P3.

At the same time, the second detection means 36 act upon the controlling means 35 to switch them to their closed configuration 235.

In this state, the storage means 31 have completed detection of the weight "G2" which corresponds, in this state, to the dead load "G1" of the wheel, and becomes the reference weight for actuation of later lifting or lowering operations, when an external force "FE" is applied to the shelf 8.

Figure 4A:
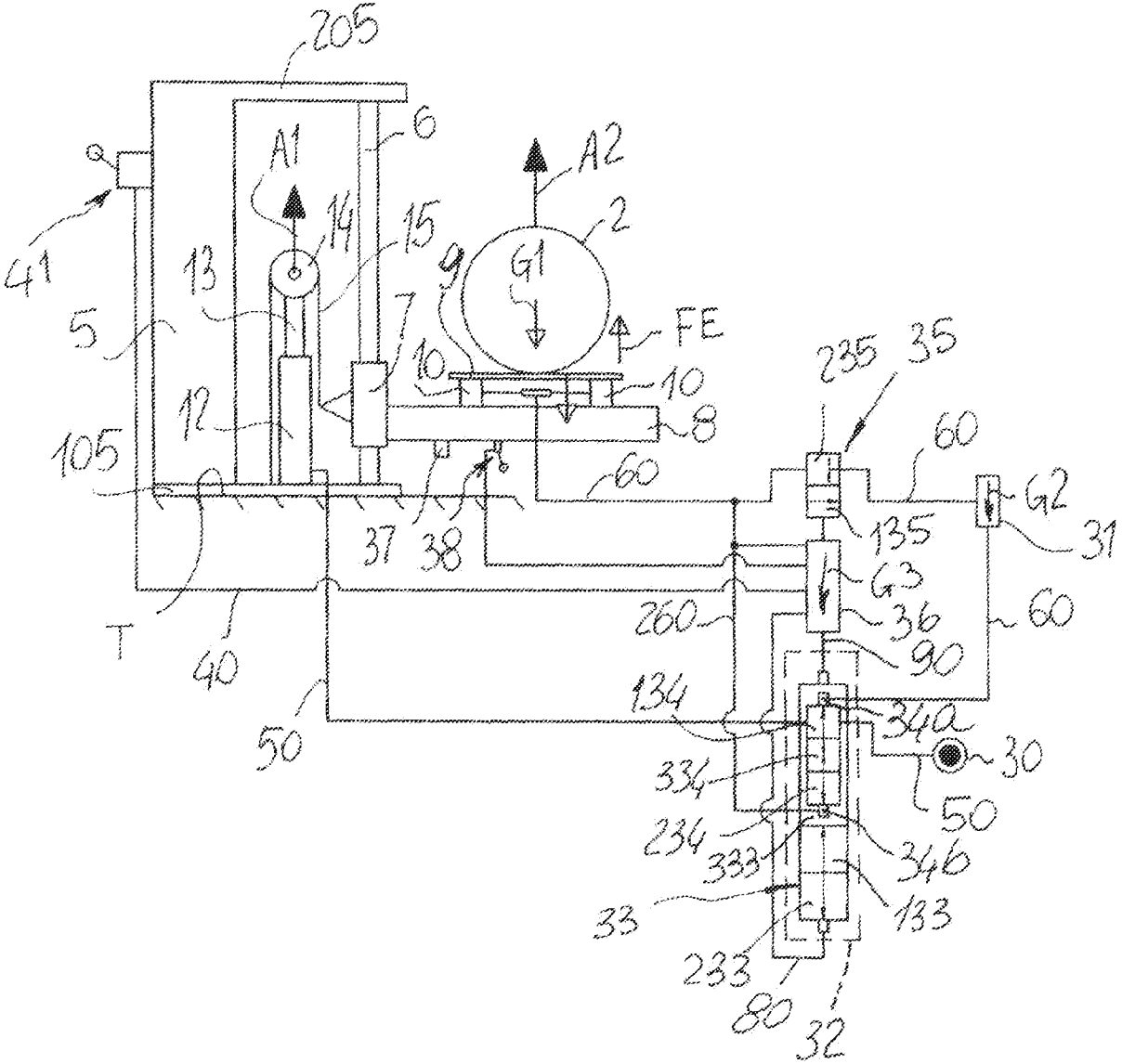
FIG. 4*a* is a diagram of the functional connections of the vertical moving apparatus of the invention, in a state in which an external wheel lifting force is applied.

In order that the shelf 8 may be further lifted, the operator applies an external upward force "FE" thereto, as shown in FIG. 4*a*.

This force causes a reduction of the weight value "G1" of the wheel 2, as its direction is opposite thereto, and this weight reduction is transferred to the end 34*b* of the second distributor 34, whereas the force of the second weight "G2" acts upon the first end 34*a*, through the line 160.

The unbalance between the weight forces "G1" and "G2" causes a displacement of the second distributor 34 in the up control state 134, in which the source 30 is placed in communication with the chamber 112 throughout the length of time of application of the external force "FE", thereby causing the shelf 8 to start raising again.

Figure 4B:
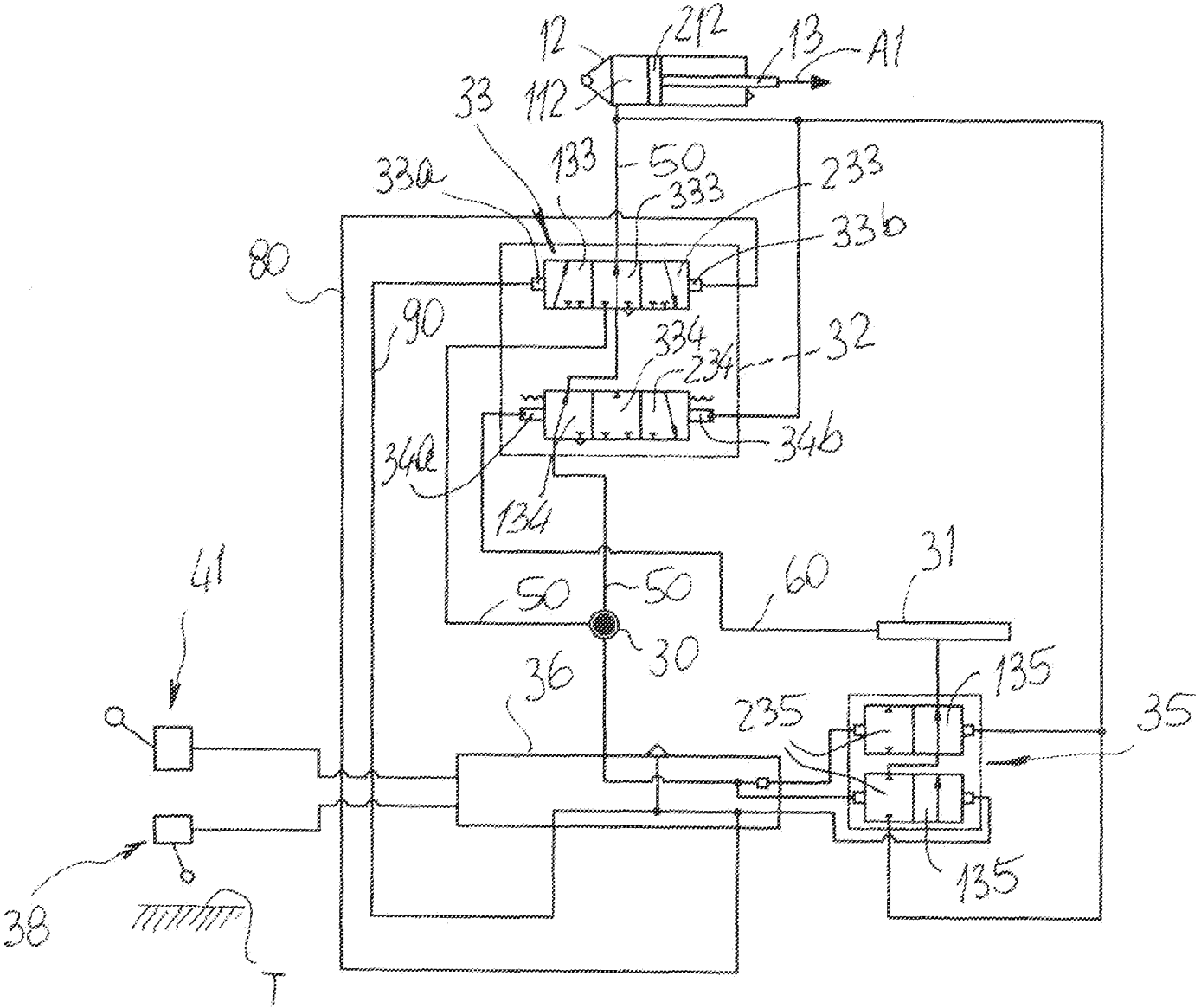
FIG. 4*b* is the diagram of the pneumatic circuit of FIG. 2, in the state of FIG. 4*a;*

Referring to FIG. 4*b*, the chamber 112 of the actuator unit 12 is connected again with the source 30, and the piston stroke restarts, as shown by arrows A1 and A2.

Figure 5A:
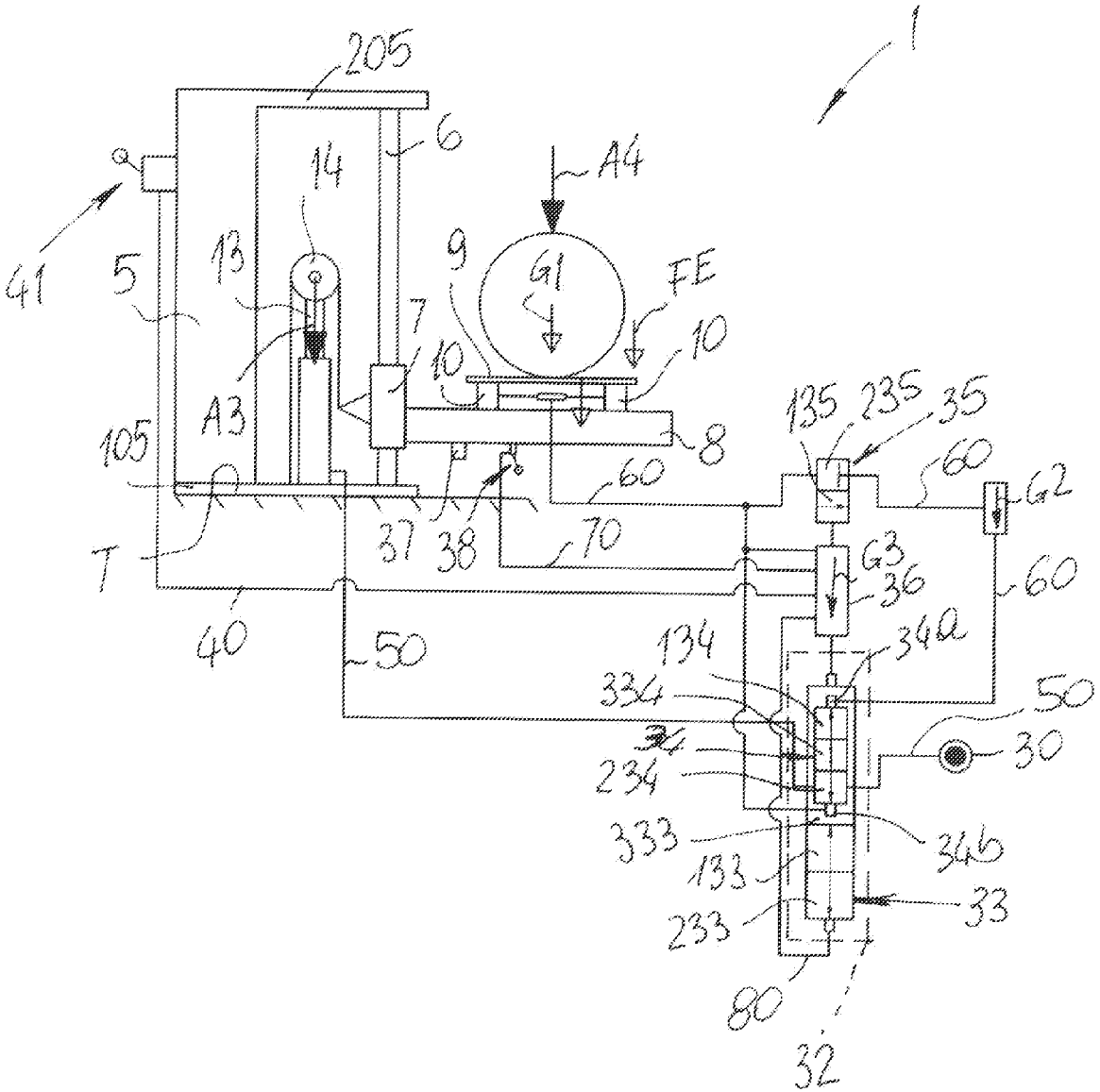
FIG. 5*a* is a diagram of the functional connections of the vertical moving apparatus of the invention, in a state in which an external wheel lowering force is applied.
Figure 5B:
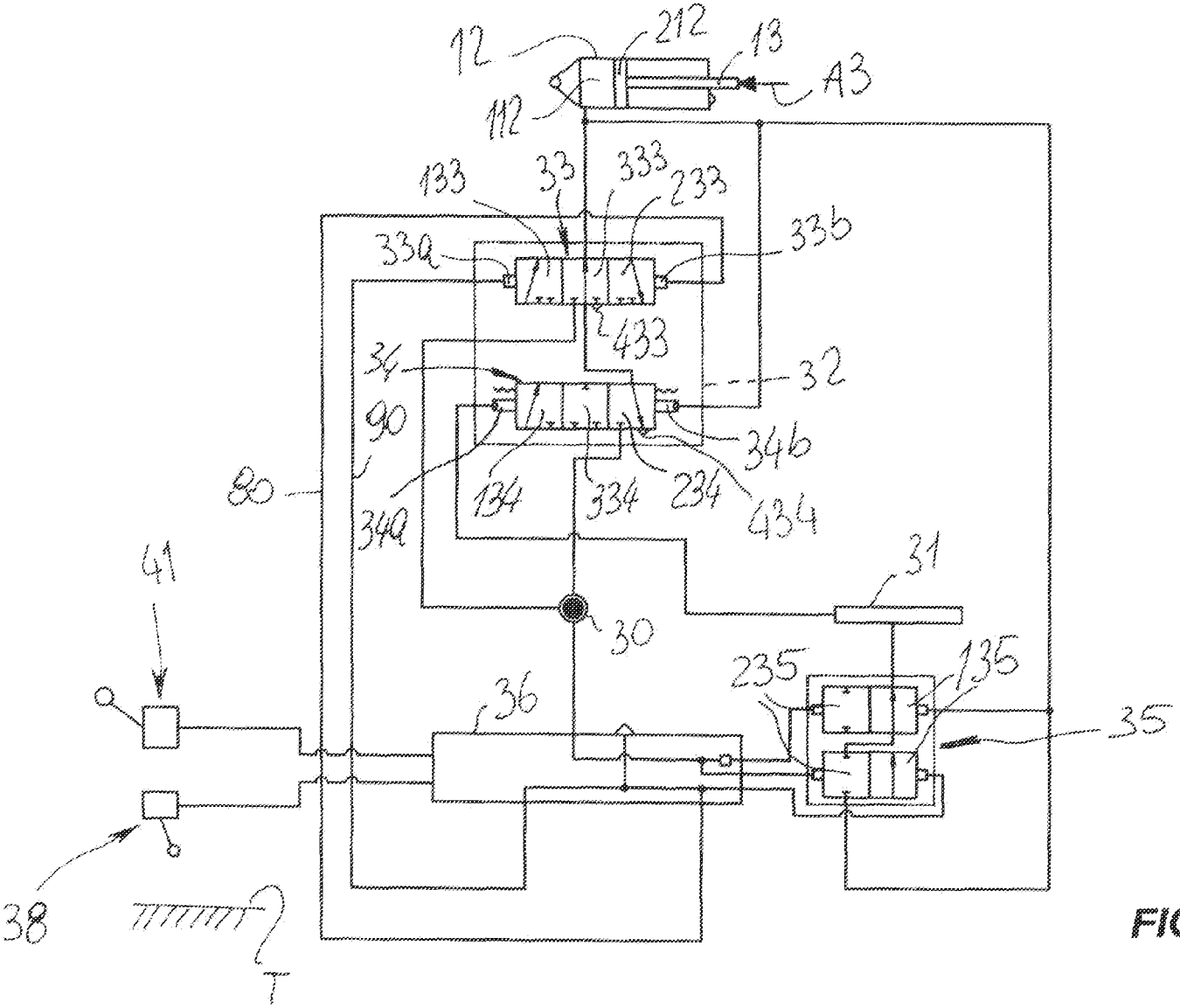
FIG. 5*b* is the diagram of the pneumatic circuit of FIG. 2, in the state of FIG. 5*a;*

The opposed lowered state is shown in FIGS. 5*a* and 5*b* and is achieved when an external downward force "FE" is applied to the shelf 8, as shown by arrows A3 and A4.

It will be noted that, in this case, the dead load "G1" is increased by the value of the external force "FE", which has the same direction, and this increase is detected by the first detection means 10, which transfer it to the end 34*b*.

Therefore, two unequal forces act upon the ends 34*a* and 34*b* of the second distributor 34, namely a force that is the sum of "FE" and the weight "G1", which act upon the end 34*b* and a force that is equal to the second weight "G2", as stored in the storage means 31, which acts upon the end 34*a*.

This unbalance causes the displacement of the second distributor 34 in the down control 234, thereby connecting the chamber 112 with a discharge 434 of the second distributor 34 (see FIG. 5*b*) and causing the actuator unit 12 to be lowered, as shown by arrows A3 and A4, due to the weight "G1" of the wheel 2 and the weights of the shelf 8 and the platform 9.

Figure 6A:
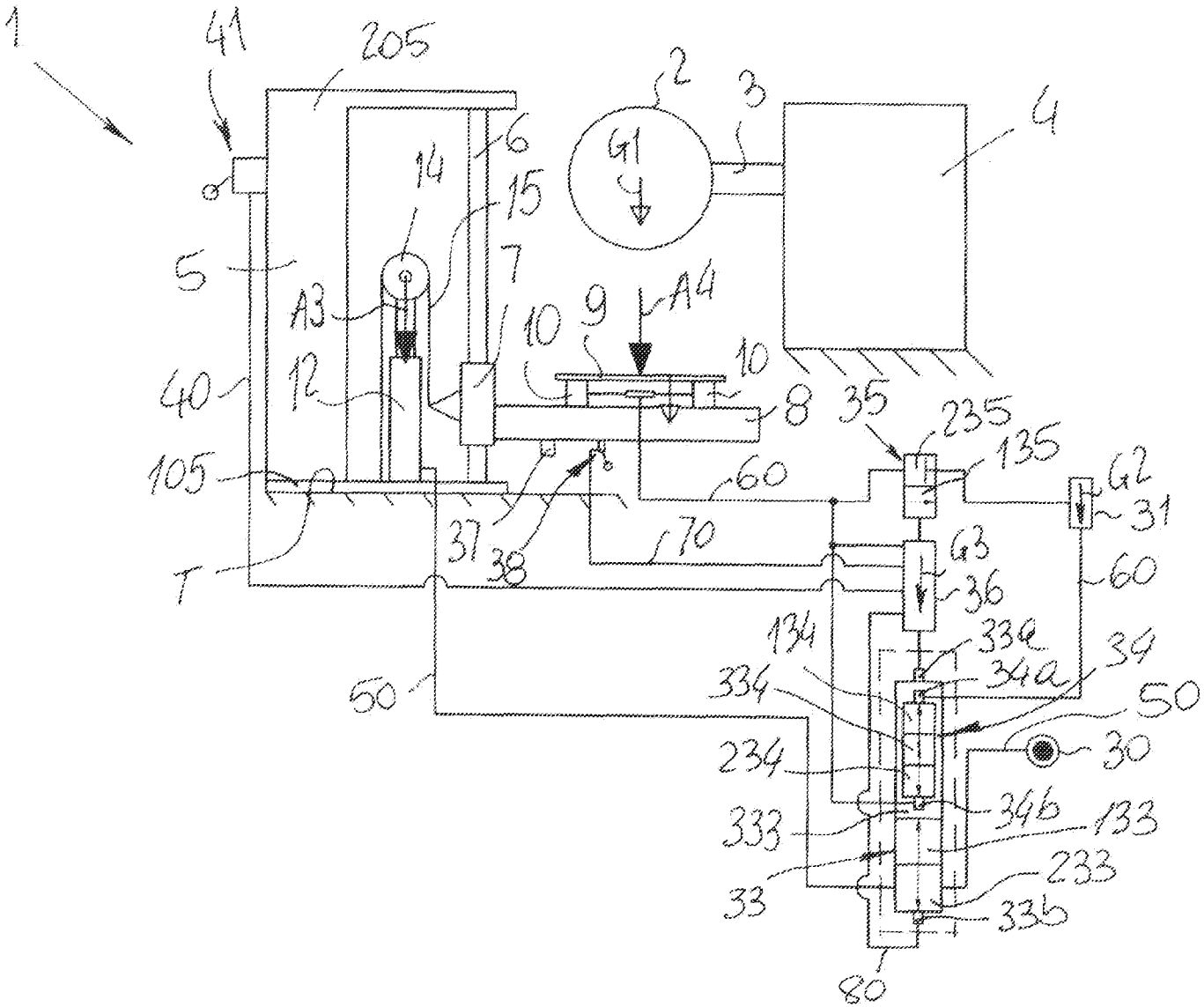
FIG. 6*a* is a diagram of the functional connections of the vertical moving apparatus of the invention, in a controlled wheel lowering state, once the wheel has been released on a balancing machine.
Figure 6B:
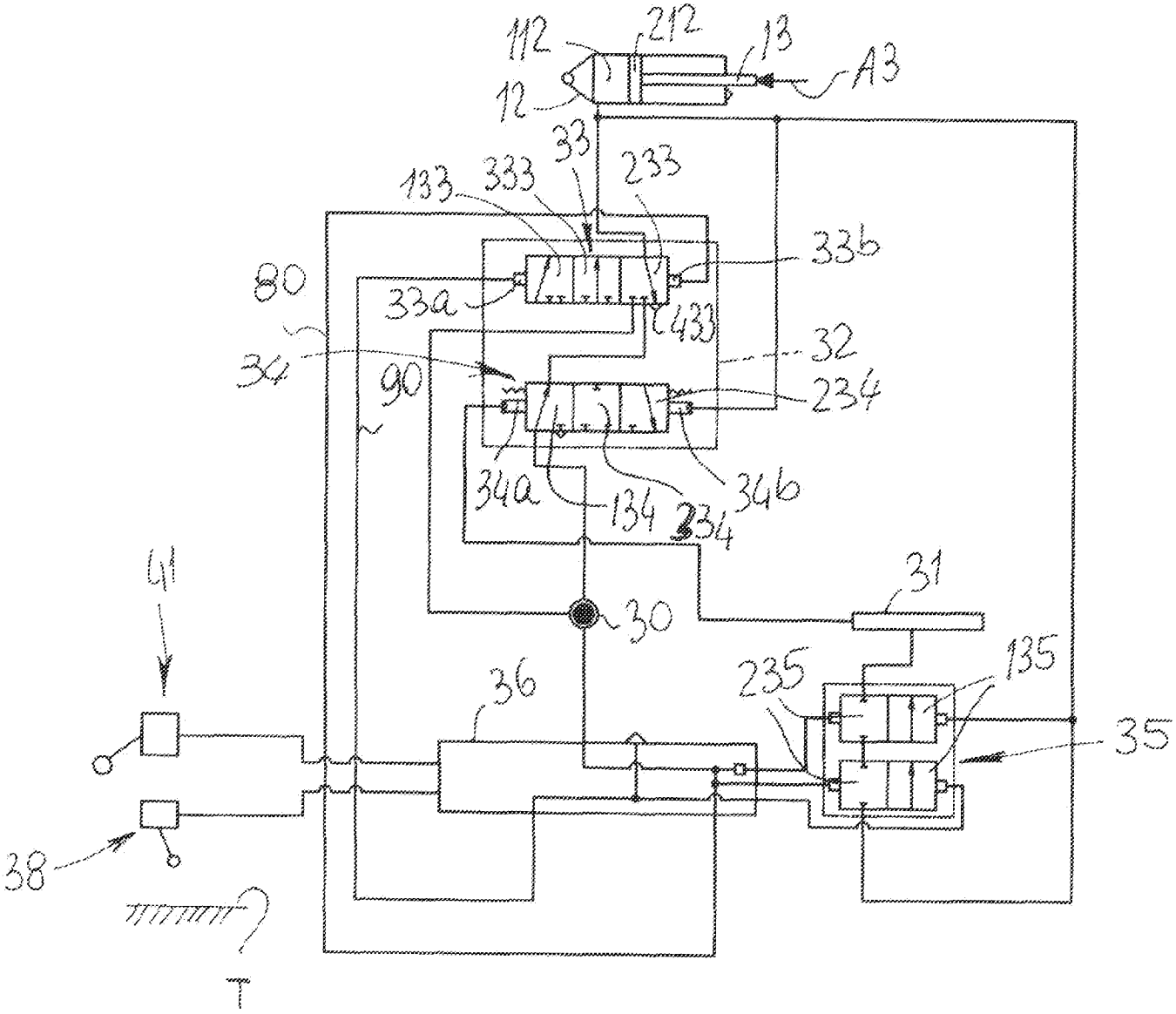
FIG. 6*b* is the diagram of the pneumatic circuit of FIG. 2, in the state of FIG. 6*a;*

Referring now to FIGS. 6*a* and 6*b*, the wheel 2 is shown as it is released on the balancing shaft 3 of a balancing machine 4 and the shelf 8 is shown as it is moved back downwards without the weight of the wheel 2 loaded thereon.

In this state, the operator switches the control 41 downwards, and the second detection means 36 that receive the control signal place the first distributor 33 in the lowering operating state 233, the sensor 38 being raised from the ground "T".

Referring to FIG. 6*b*, it will be appreciated that in this configuration the chamber 112 of the actuator unit 12 is connected with the discharge 433, which allows the piston 212 to be lowered.

Figure 7A:
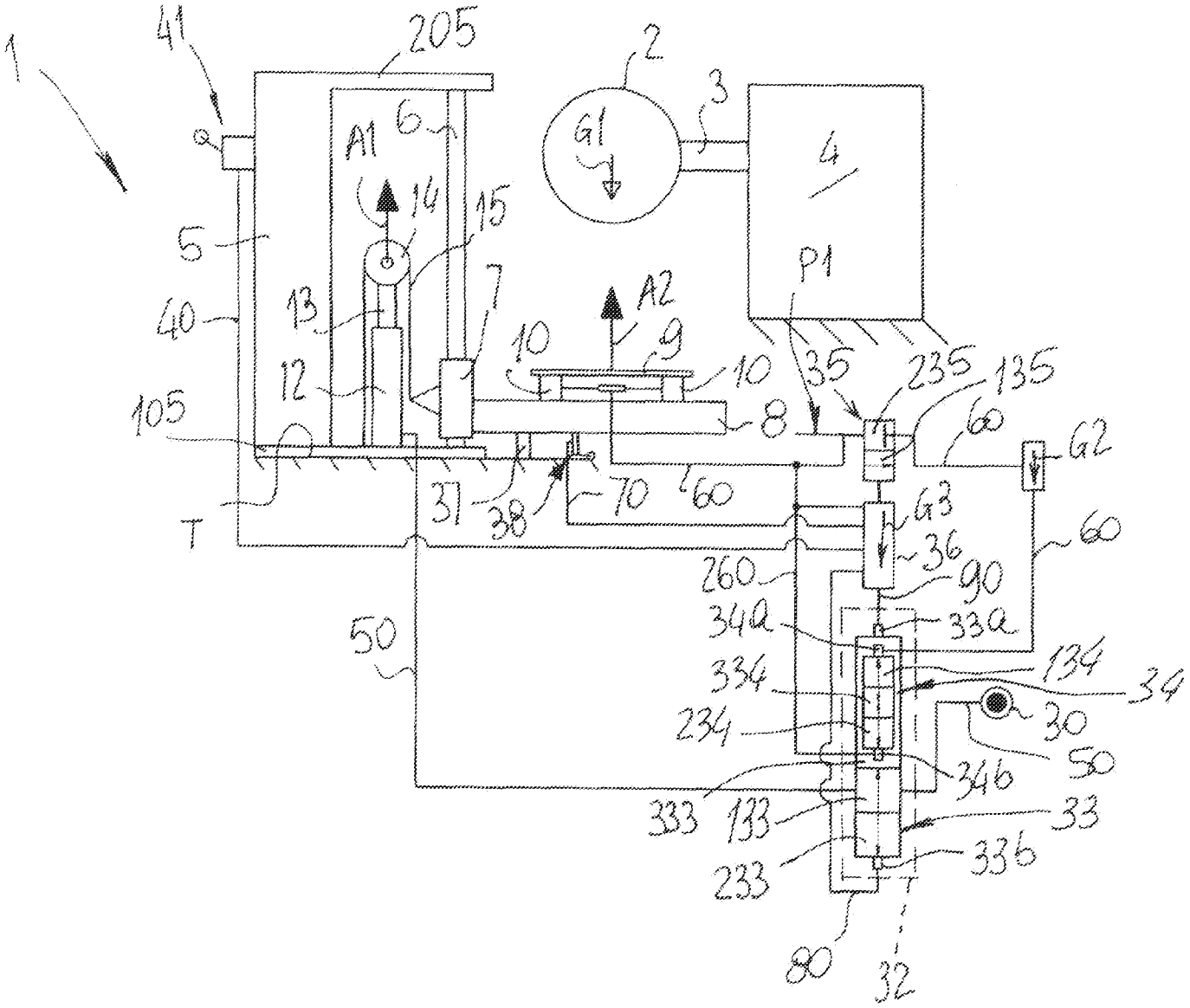
FIG. 7*a* is a diagram of the functional connections of the vertical moving apparatus of the invention, in a state in which controlled lifting is started for recovery of the wheel from the balancing machine.
Figure 7B:
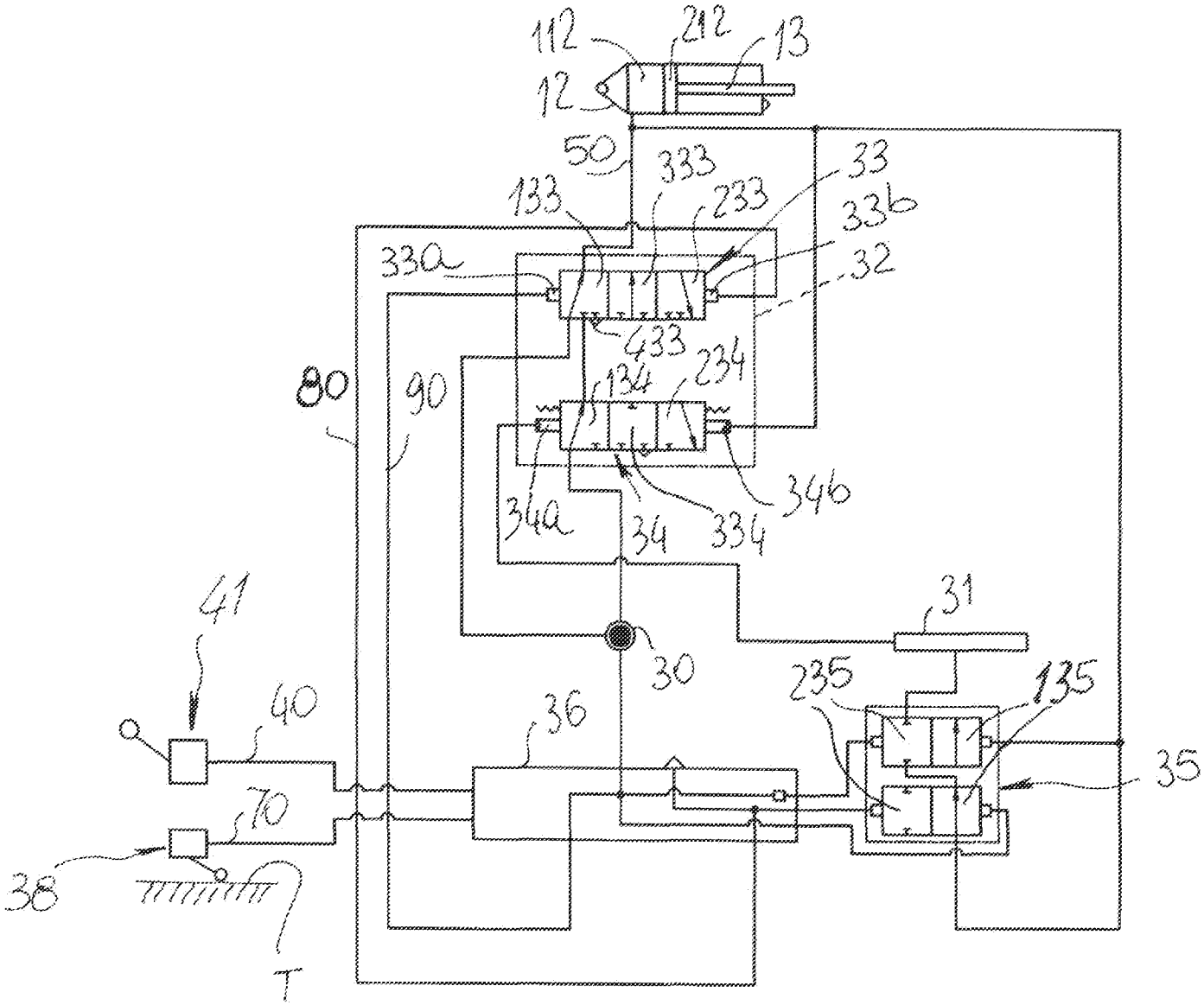
FIG. 7*b* is the diagram of the pneumatic circuit of FIG. 2, in the state of FIG. 7*a;*

Referring to FIGS. 7*a* and 7*b*, a state in which the wheel 2 is recovered from the balancing machine 4 is shown.

The operator switches the control 41 upwards, and the second detection means 36 that receive this control signal and also the signal from the sensor 38 in contact with the ground "T", accordingly switch the first distributor 33 to the lifting operating state 133.

The second detection means 36 also detect that no wheel 2 is loaded on the platform 9 (or shelf 8) (the weight "G1" is still loaded on the shaft 3 of the balancing machine 4).

This is because a predetermined minimum weight value "G3" has been previously stored by the manufacturer in the second detection means 36.

When the second detection means 36 detect that the platform 8 has no body with a dead load at least as high as the weight "G3" loaded thereon, but a weight lower than this, they hold the controlling means 35 in their closed position 235.

In this state, as better shown in FIG. 7*b*, the source 30 is connected to the chamber 112 through the first distributor 33 and supplies power to it.

Therefore, the piston 212 starts to raise again toward the plane P2 on which the wheel 2 to be picked up and removed from the shaft 3 lies, as shown by arrows Al and A2, starting from the plane P1.

Figure 8A:
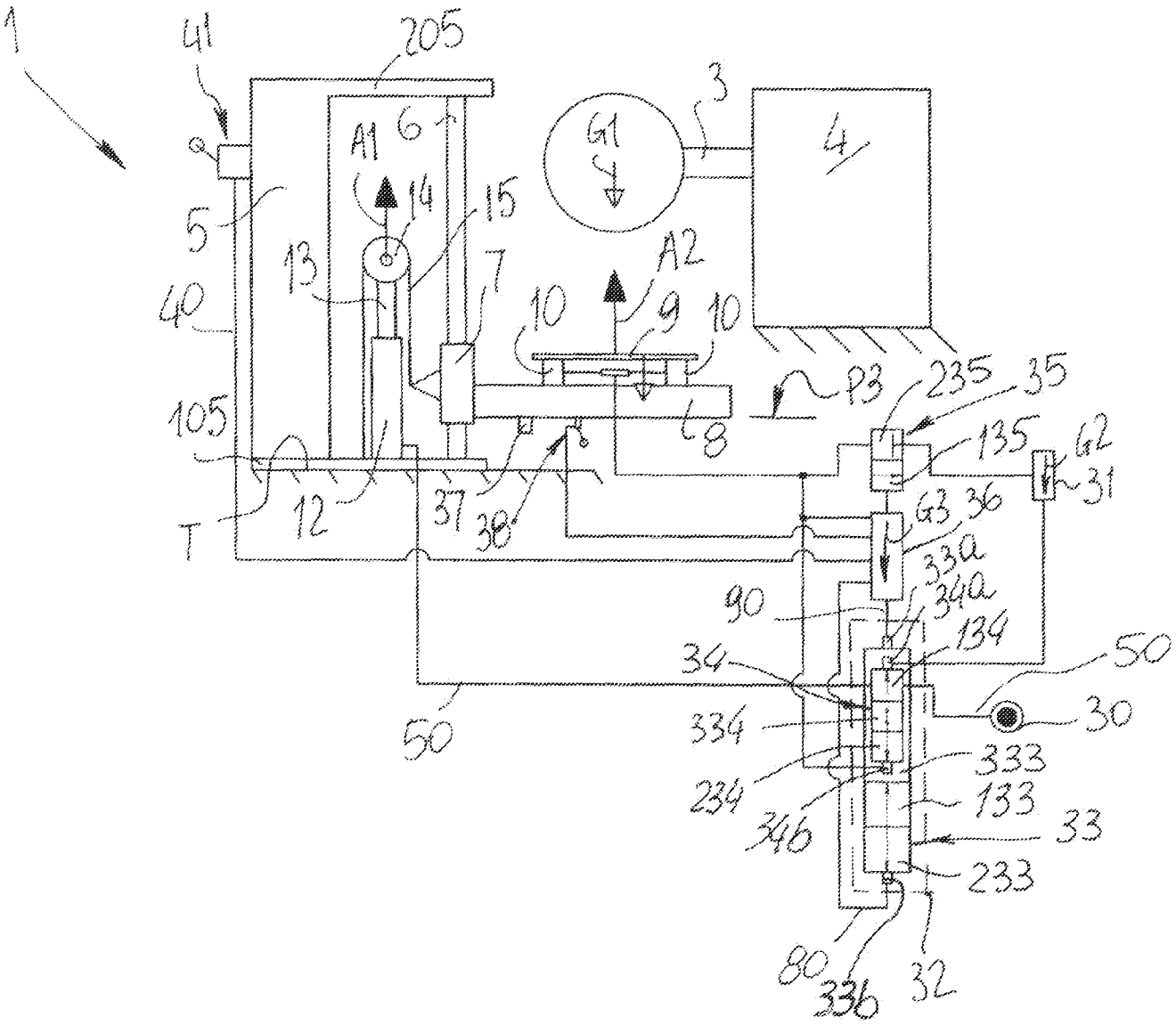
FIG. 8*a* is a diagram of the functional connections of the vertical moving apparatus of the invention, in a controlled lifting state for recovery of the wheel from the balancing machine.
Figure 8B:
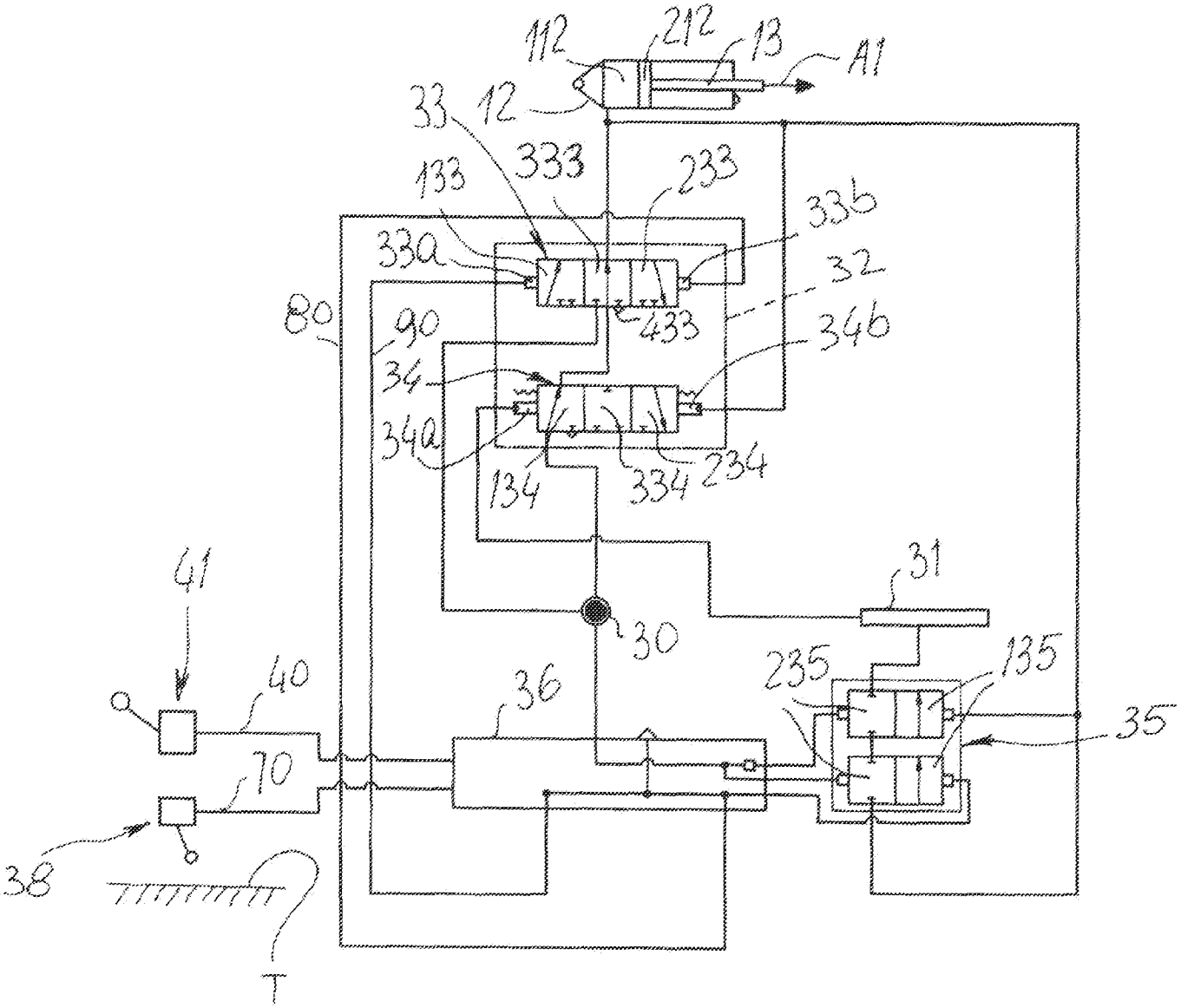
FIG. 8*b* is the diagram of the pneumatic circuit of FIG. 2, in the state of FIG. 8*a;*

Referring to FIGS. 8*a* and 8*b*, a state is shown in which the shelf 8 is lifted from the plane P1 to the plane P3, due to the lack of the first weight "G1" of the wheel 2 on the shelf 8.

As is shown, the sensor 38 is lifted again from the ground "T" and this state is detected by the second detection means 36, as well as the signal that comes from the control 41 with the connection line 40.

The first distributor 33 is switched to the operating state 333 and the second distributor 34 is switched to the up-control state 134 due to the unbalance of the forces that act upon the ends 34*a* and 34*b*, given that it is actually as if an external force "FE" having a strength equal to the weight "G1" were upwardly applied to the shelf 8.

In this configuration, until the platform 9 contacts the wheel 2, the source 30 remains connected to the chamber 112, powers it and causes the shelf 8 to be lifted toward the wheel 2.

Figure 9A:
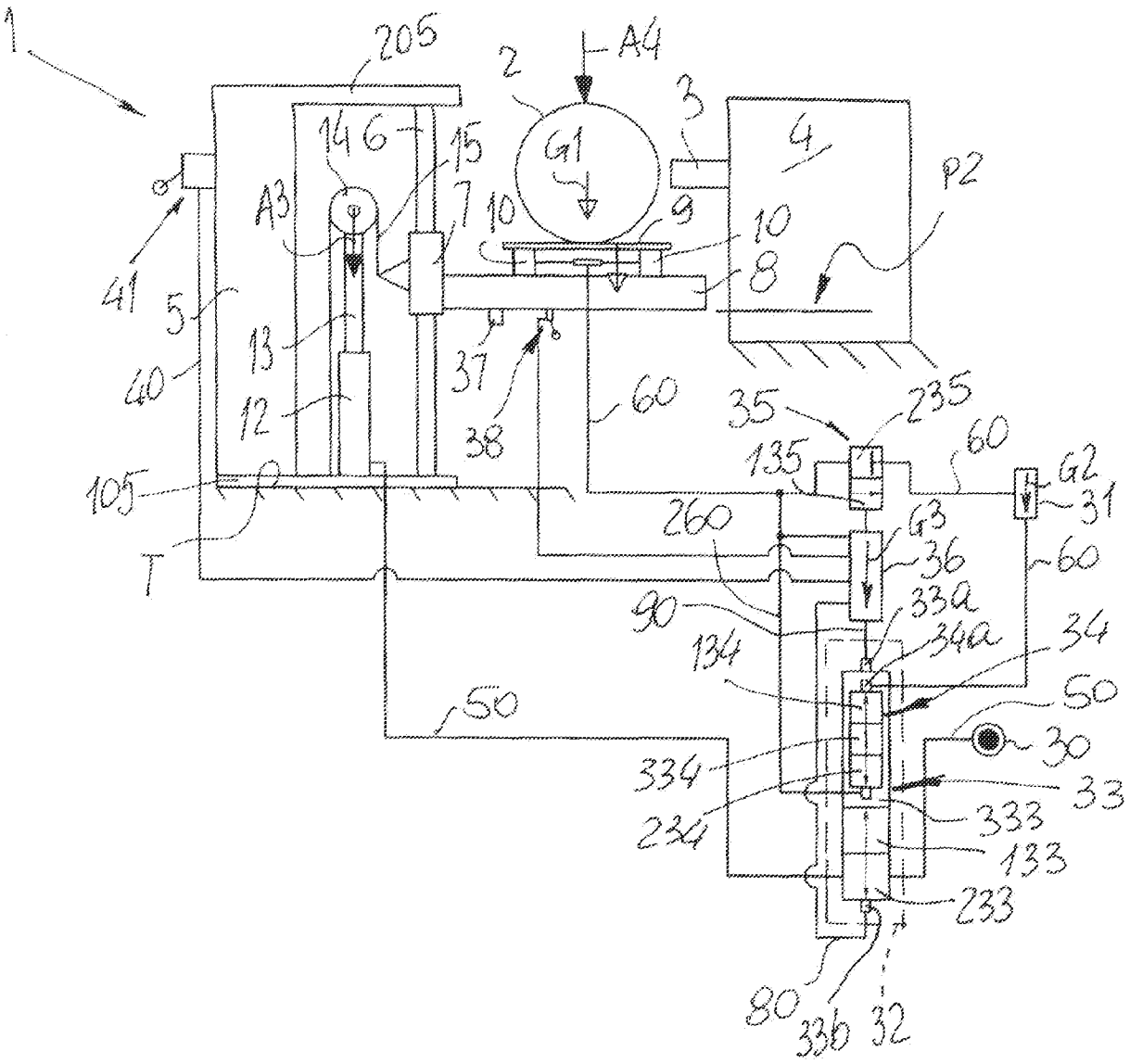
FIG. 9*a* is a diagram of the functional connections of the vertical moving apparatus of the invention, in a controlled wheel lowering state, once the wheel has been recovered from the balancing machine.
Figure 9B:
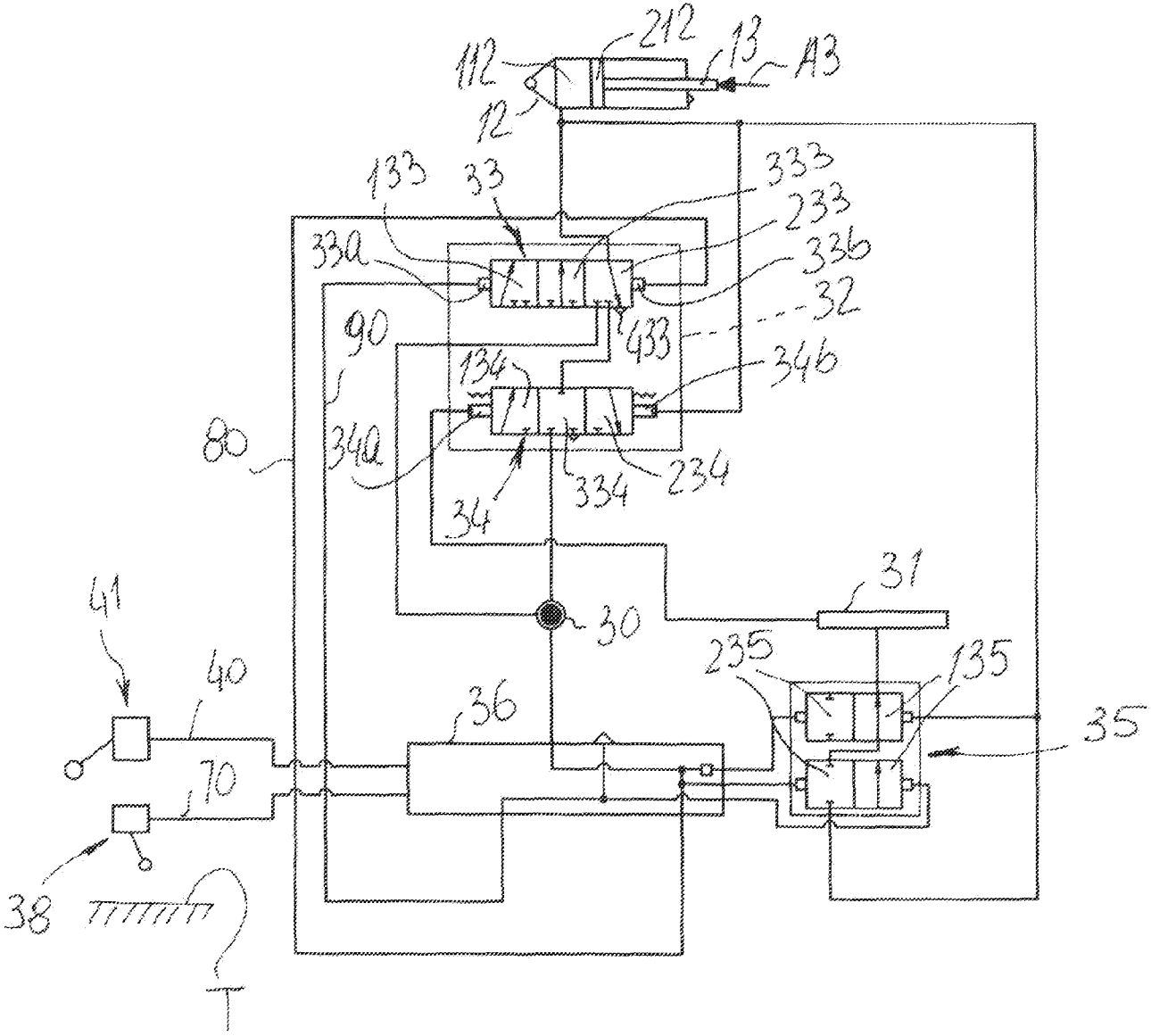
FIG. 9*b* is the diagram of the pneumatic circuit of FIG. 2, in the state of FIG. 9*a;*

Referring to FIGS. 9*a* and 9*b*, a state is shown in which the operator imparts a down-control to the shelf 8 once the wheel 2 has been loaded again on the platform 9.

In this state, the sensor 38 is raised from the ground "T" and the control 41 is selected downwards by the operator.

Accordingly, the second detection means 36 act upon the first distributor 33 to switch it to the lowering operating state 233 as shown by arrows A3 and A4.

In this state, as shown in FIG. 9*b*, the chamber 112 of the actuator unit 12 is connected with the discharge 433 of the first distributor 33.

This allows the piston 212 to move downwards as shown by arrow A3.

The source 30 is totally disconnected from the actuator unit 12.

In this state, the shelf 8 and the platform 9 with the wheel 2 loaded thereon may be lowered to the starting plane "P1", which is located substantially level with the ground "T", whereupon the operator may unload the wheel 2 from the platform 9.

Referring now to FIG. 10, a second embodiment of the moving means 11 is shown, which does not substantially alter the operation of the apparatus 1 as described above.

Referring to FIG. 11, which shows the third embodiment of the apparatus 11, it will be appreciated that the contact sensor 38 is no longer designed to detect contact with the ground "T", but to detect contact with the shelf 8 when the latter moves vertically with respect to the base 105.

The skilled person will understand that in the configuration with the scissor-like frame 18 two of the ends of the rods that compose it are hinged to the shelf 8 and the base 105, and the other two are hinged to blocks 108 sliding along the shelf 8 and the base 105, to allow the rods to move.

The operation of the pneumatic circuit that actuates the apparatus 1 in this third embodiment is equal to the one that has been described for the first embodiment excepting, as mentioned above, the contact detection feature of the sensor 38.

The skilled person will understand that the above described pneumatic circuit may be also replaced with a hydraulic circuit, if required, or possibly with an electric/electronic circuit.

Furthermore, the second detection means 36 include an electronic logic, which makes them suitable for the above described purposes.

It shall be also noted that the actuator unit 12 may also carry out the detection tasks of the first detection means 10 which may thus be eliminated.

Therefore, the actuator unit 12 detects pressure variations in the chamber 112, that are caused by the weight "G1" and the external force "FE", if any.

This feature is shown in the pneumatic circuit diagrams of FIGS. 1*b*-9*b*, in which the first detection means 10 are omitted and the pressure variations are transferred to the chamber 112 through the cable segment 15, the pulley 15 and the stem 13 of the piston 212.

The invention was found to fulfill the intended objects.

The invention so conceived is susceptible to a number of changes and variants within the inventive concept.

Furthermore, all the details may be replaced by other technically equivalent parts.

In practical implementation, any materials, shapes and sizes may be used as needed, without departure from the scope of the following claims.

The invention claimed is:

1. A balanced vertical moving apparatus (1) designed to move a body (2) having a first weight (G1) toward, or from a selected elevation (P1, P2, P3) comprising:

a loading device (8, 9) configured to have said body (2) loaded thereon;

an upward or downward moving system (11) of said loading device (8, 9), actuated by a power source (30);

a first detecting unit (10) of said first weight (G1);

a reference weight storage unit in a storage device (31) connected with said first detecting unit (10); and a driving system (32) of said moving system (11) connected to said first detecting unit (10) and said storage device (31) and designed to actuate said moving system (11), said driving system (32) comprising at least two alternatively selectable operating conditions, a first forced lowering condition (233), a second automatic operating condition (333), wherein a control lifting position (134) or a control lowering operating position (234) is selected when an additional force (FE) is applied on said loading device (8, 9) from outside, or a stop position (334) is selected when no additional force (FE) is applied to said loading device (8, 9) from outside, and wherein said driving system (32) further comprises a second detecting unit (36) designed to detect said first weight (G1), an actuating position of control (41), a position of a position sensor (38) and of said loading device (8,9).

2. The balanced vertical moving apparatus as claimed in claim 1, wherein said driving system (32) comprise a further forced lifting operating condition (133) alternatively selectable with respect of said first (233) or second (333) operating conditions.

3. The balanced vertical moving apparatus as claimed in claim 1, wherein said second operating condition (333) of automatic actuation comprises said control lifting position (134) of said loading device (8,9) selected when said additional force (FE) is a lifting force applied from the outside, said control lowering position (234) of said loading device (8, 9) when an additional force (FE) is a lowering force applied from the outside, said stop position (334) of said loading device (8,9) being in an intermediate position.

4. The balanced vertical moving apparatus as claimed in claim 1, wherein said second detecting unit (36) comprise a stored value of a third reference weight (G3).

5. The balanced vertical moving apparatus as claimed in claim 1, wherein said moving system comprise:

a frame (5) that holds a guiding device (6); and an actuating arrangement (12) connected to said loading device (8,9) by a sliding connecting unit (7) sliding on said guiding device (6).

6. The balanced vertical moving apparatus as claimed in claim 5, wherein said connecting unit comprises:

an upright member (6) vertically held on said frame (5); and a sleeve (79) slidingly arranged on said upright member (6) and connected to said actuating arrangement (12).

7. The balanced vertical moving apparatus as claimed in claim 5, wherein said frame comprises a scissors or crossing-arms frame (18).

8. The balanced vertical moving apparatus as claimed in claim 7, wherein a cam member (19, 20) having sliding surfaces (119, 120) for a sliding element (21) fixed on said moving system (11) is interposed between said moving system (11) and said scissors or crossing-arms frame (18).

9. A system for maintenance of a vehicle's wheels (2) comprising:

a balanced vertical moving apparatus (1) as claimed in claim 1; and at least an operating machine (4) for maintenance of said vehicle's wheels (2).

10. A balanced vertical moving apparatus (1) designed to move a body (2) having a first weight (G1) toward, or from a second elevations (P1, P2, P3) comprising:

a loading device (8, 9) configured to have said body (2) loaded thereon;

an upward or downward moving system (11) of said loading device (8,9), actuated by a power source (30);

a first detecting unit (10) of said first weight (G1);

a reference weight storage unit in a storage device (31) connected with said first detecting unit (10); and a driving system (32) of said moving system (11) connected to said first detecting unit (10) and said storage device (31) and designed to actuate said moving system (11), said driving system (32) comprising at least two alternatively selectable operating conditions, a first forced lowering condition (233), a second automatic operating condition (333), wherein a control lifting position (134) or a control lowering operating position (234) is selected when an additional force (FE) is applied on said loading device (8,9) from outside, or a stop position (334) is selected when no additional force (FE) is applied to said loading device (8,9) from outside, wherein said driving system (32) further comprises a second detecting unit (36) designed to detect said first weight (G1), an actuating position of control (41), a position of a position sensor (38) and of said loading device (8,9), and wherein a control unit (35) of said storage is interposed between said storage device (31) and said first detecting unit (10).

11. The balanced vertical moving apparatus as claimed in claim 10, wherein said control unit (35) of said storage is slaved to said second detecting unit (36) and has two alternatively selectable work positions, a first storing position (135) and a second block-storing position (235), said first or second storing positions being selectable by said second detecting unit (36), said second block-storing position (235) being selected at least when said first detecting unit (10) detects a weight lower than said third reference weight (G3).

* * * * *